US011346625B2

(12) United States Patent
Calvete et al.

(10) Patent No.: US 11,346,625 B2
(45) Date of Patent: May 31, 2022

(54) RIFLES AND MUZZLE LOADING RIFLES RECEIVING PROPELLANT CHARGES IN BREAK OPEN AND BOLT ACTION CONFIGURATIONS, AND BARREL EXTENSIONS THEREFOR

(71) Applicant: Ardesa, S.A., Zamudio-Vizcaya (ES)

(72) Inventors: Angel Calvete, Zamudio-Vizcaya (ES); Thomas F. Hall, Higganum, CT (US); John Myles, Quaker Hill, CT (US); Ryan Nicholas, Scottsdale, AZ (US)

(73) Assignee: Ardesa, S.A., Zamudio-Vizcaya (ES)

( * ) Notice: Subject to any disclaimer, the term of this patent is extended or adjusted under 35 U.S.C. 154(b) by 0 days.

(21) Appl. No.: 17/158,195

(22) Filed: Jan. 26, 2021

(65) Prior Publication Data

US 2021/0164744 A1 Jun. 3, 2021

Related U.S. Application Data

(62) Division of application No. 16/885,601, filed on May 28, 2020, now Pat. No. 11,137,224.

(Continued)

(51) Int. Cl.
*F41A 15/06* (2006.01)
*F41A 15/14* (2006.01)

(Continued)

(52) U.S. Cl.
CPC ..... *F41A 9/55* (2013.01); *F41A 3/24* (2013.01); *F41A 3/58* (2013.01); *F41A 3/66* (2013.01);

(Continued)

(58) Field of Classification Search
CPC ..... F41A 3/16; F41A 3/24; F41A 3/22; F41A 3/18
See application file for complete search history.

(56) References Cited

U.S. PATENT DOCUMENTS 4,232,468 A 11/1980 Chapin
5,822,904 A 10/1998 Beal (Continued)

FOREIGN PATENT DOCUMENTS

CA 2709047 A1 * 6/2011 ..... F41A 3/24
WO WO-8505172 A1 * 11/1985 ..... F41A 17/32

*Primary Examiner* — Reginald S Tillman, Jr.
(74) *Attorney, Agent, or Firm* — DeLio Peterson & Curcio LLC; Robert Curcio

(57) ABSTRACT

A break open rifle and bolt action rifle having a barrel extension with a breech end for receiving a propellant charge, a muzzle end with an extended attachment structure for receiving a complementary attachment structure of a barrel, and a chamber disposed within and through the barrel extension having a first diameter at a first end and a narrowing portion adjacent a second end opposite the first end, the narrowing portion having a second diameter smaller than the first diameter, wherein the first diameter of the chamber is sized to receive the propellant charge therein, and the second diameter of the narrowing portion is sized to prevent the propellant charge from being further inserted past the narrowing portion, and to prevent a projectile from being inserted through the chamber from the barrel muzzle end. A bolt action configuration having dual diameter non-rotating bolt with an extractor and ejector mechanism for removing a propellant charge.

18 Claims, 22 Drawing Sheets

Related U.S. Application Data

(60) Provisional application No. 62/889,769, filed on Aug. 21, 2019.

(51) Int. Cl.

| | |
|---|---|
| ***F41A 9/55*** | (2006.01) |
| ***F41A 9/58*** | (2006.01) |
| ***F41A 9/70*** | (2006.01) |
| ***F41A 21/12*** | (2006.01) |
| ***F41A 3/66*** | (2006.01) |
| ***F41A 3/24*** | (2006.01) |
| ***F41A 3/58*** | (2006.01) |
| ***F41A 21/48*** | (2006.01) |
| *F42B 14/06* | (2006.01) |

(52) U.S. Cl.

CPC ..... *F41A 9/58* (2013.01); *F41A 9/70* (2013.01); *F41A 21/12* (2013.01); *F41A 21/482* (2013.01); *F41A 15/06* (2013.01); *F41A 15/14* (2013.01); *F42B 14/06* (2013.01)

(56) References Cited

U.S. PATENT DOCUMENTS

| | | | | |
|---|---|---|---|---|
| 7,726,245 | B2 | 6/2010 | Quesenberry | |
| D625,380 | S | 10/2010 | Walter | |
| 9,046,332 | B2 | 6/2015 | Peterson | |
| 9,157,713 | B1 | 10/2015 | Peterson | |
| 9,329,003 | B2 | 5/2016 | Peterson | |
| 9,377,277 | B1 | 6/2016 | Worrell, Jr. | |
| 9,562,754 | B2 | 2/2017 | Peterson | |
| 10,030,956 | B2 | 6/2018 | Peterson | |
| 10,254,092 | B1 | 4/2019 | Worrell, Jr. | |
| 2002/0129531 | A1 | 9/2002 | Camp | |
| 2003/0089014 | A1* | 5/2003 | Schuerman | F41A 35/06 42/16 |
| 2005/0183318 | A1 | 8/2005 | McGivern | |
| 2005/0257711 | A1 | 11/2005 | Husseini | |
| 2010/0275487 | A1 | 11/2010 | Quesenberry | |
| 2010/0281733 | A1* | 11/2010 | Constant | F41A 3/66 42/16 |
| 2018/0321022 | A1 | 11/2018 | Peterson | |

* cited by examiner

RIFLES AND MUZZLE LOADING RIFLES RECEIVING PROPELLANT CHARGES IN BREAK OPEN AND BOLT ACTION CONFIGURATIONS, AND BARREL EXTENSIONS THEREFOR

BACKGROUND OF THE INVENTION

1. Field of the Invention

This invention relates generally to firearms, and more particularly to rifles and muzzleloading rifles in break action and bolt action configurations, and barrel extensions therefor. The invention further relates to different bolt action configurations for loading and unloading a bolt action rifle utilizing a non-rotating bolt with ejector and extraction mechanisms located on the bolt and accompanying receiver.

2. Description of Related Art

Like most early firearms, the first rifles were muzzleloading firearms, in which the projectile and the propellant charge are loaded from the muzzle of the gun (i.e., from the forward, open end of the gun's barrel). This is distinct from the more popular modern designs of breech loading firearms. There are generally three types of muzzleloading firearms: inline 209 primers and percussion, caplock, and flintlock muzzleloaders. Inline 209 primers and percussion muzzleloaders tend to look like most modern firearms. The inline and caplock muzzleloaders differ on where the percussion cap holding nipple is attached. In an inline muzzleloader, the percussion cap is in line with the hammer and the barrel. The inline has the nipple attached to the barrel at the breech and accessed by a bolt or break action. Also, the inline model has a removable breech plug to facilitate cleaning. Caplock rifles have a side-mounted firing pin similar to the flintlock rifle, and operate and load in much the same way, but use a more modern pre-loaded firing cap to fire the rifle. A flintlock style of muzzleloader dates back to the 17th century and features a flintlock mechanism that produces sparks when a piece of flint strikes its steel frizzen.

Loading a traditional black powder muzzleloader firearm generally involves a certain amount of complexity (as compared to the loading of modern firearms). For loose, granular powder such general steps include: a) making sure the rifle is not primed; b) making sure the rifle bore is clean of fouling and oil; c) setting a powder measure for a desired powder charge; d) pouring the powder into the measure and then into the muzzle end of the rifle; and e) using a ramrod, pressing the bullet, such as a patched round ball, past the rifling and down the bore until it contacts the powder charge.

The ammunition components generally used in muzzle loaded rifles has evolved from a projectile that is a round ball compressed in the muzzle end with a surrounding patch, to projectiles that have incorporated features of modern bullets. Within the latter category, bullet shaped projectiles can be further subdivided into those that are fired with a sabot or gas check (which replaces the patch), and projectiles that are lubricated slugs. A sabot is an encasing plastic cup that ensures the correct positioning of a projectile or shell in the barrel of a gun, attached either to the projectile or inside the barrel and falling away as it leaves the muzzle. The sabot prevents the escape of gas ahead of the projectile, eliminates the need for a lubricating means, and assures that there is a good seal between the projectile and the bore of the barrel.

Current muzzle loading ammunition comprises multiple parts that are combined together when loaded into a firearm.

Because the various parts are separate, they are not sealed, and they use pyrotechnic materials such as black powder or black powder substitutes that tend to be hygroscopic (they tend to absorb moisture from their surroundings and in particular absorb water vapor from the atmosphere). As a result, their efficacy degrades over time, and the propellant and resultant combustion products tend to corrode the firearm barrel and chamber, and accuracy and reliability are compromised.

A complete round of ammunition consists of all the components necessary for one firing of the gun. In muzzleloading, these normally include a projectile, the propellant or busting charge, and a primer that ignites the propellant, and in breech loaded firearms, a case is required to house the powder, primer and projectile For muzzleloading firearms, multiple ammunition components are loaded from the open muzzle end of the barrel. These multiple components include at least a propellant charge and projectile. The propellant charges comprise a predetermined amount of black powder, black powder substitutes, or smokeless gunpowder. The projectile typically comprises a bullet and a sabot. In some instances, the projectile and the propellant charge are inserted into the barrel as a unitary structure. Alternatively, the propellant charge is loaded separately from the projectile. In such instances, the propellant charge is loaded first into the barrel, followed by the sabot and the bullet.

Ammunition has evolved over the years, but some general terminology has remained constant, and the terms are used herein in their accepted fashion:

a) propellant charge generally is the ammunition component that causes the explosive charge to propel the bullet, and may be referred herein as the combination of propellant, primer, and propellant charge case in a single unit. The propellant charge case is generally cylindrical in shape and includes an internal lumen. A propellant is contained within the lumen of the propellant charge case. Ignition of the propellant provides the energy that propels the bullet;

b) a "round" is a term synonymous with a fully loaded propellant charge containing a projectile, propellant, primer and casing; and c) a "fixed round" is a round of ammunition which when stored outside of the firearm chamber prior to loading the round, has the propellant and the bullet commonly engaged to each other by direct engagement.

Loading or charging propellants into muzzleloading guns has long presented problems. The propellant, either black powder or a substitute thereof, is normally handled in granular form (grains), with each charge being determined by measuring out a selected weight or volume of the propellant from a bulk supply, delivering it to the muzzle end bore of the gun, placing a projectile in the bore, and seating the charge by ramrod into the breech. The charging of this propellant thus requires special tools and implements which must be carried to the field of use and kept readily available for re-loading. In addition, there is always the risk of improper measurement and spillage of loose powder. Other problems exist. It is difficult to obtain uniform powder compaction from load to load. It is difficult to re-load with speed and accuracy, and the use of smokeless powder, if not properly measured, could pose an additional hazard.

Other prior art muzzleloaders may see the propellant loaded into breech end of the rifle's barrel, instead of through the muzzle with the projectile. Such breech loading designs require further machining of the barrel itself, which may result in a reduced integrity of the barrel, require additional manufacturing steps, and may also require additional steps needed to install the barrel onto the rifle.

As an example, bolt action muzzleloaders are commonly loaded in the following manner: a) open the bolt; b) apply pre-measured propellant charge (powder) to the muzzle end of the barrel; c) insert the projectile into the muzzle end of the barrel; d) once the projectile is started down the muzzle end of the barrel, force the projectile all the way down the barrel with a ramrod; e) insert the primer into the breech end receiver; and f) close the bolt. This load/reload procedure is inefficient since the rifle has no mechanical means to feed the propellant charge directly into the breach, such as a magazine.

SUMMARY OF THE INVENTION

Bearing in mind the problems and deficiencies of the prior art, it is therefore an object of the present invention to provide a muzzleloading firearm that receives a propellant charge directly within a specially designed barrel extension, which assist in removing the need for additional machining and manufacturing steps performed on the barrel itself, and thus increases the simplicity of tooling.

It is another object of the present invention to provide a muzzleloading bolt action firearm that allows for more efficient reloading of the propellant charge by way of interaction between a propellent charge magazine and a bolt.

Still other objects and advantages of the invention will in part be obvious and will in part be apparent from the specification.

In a first aspect, the present invention is directed to a barrel extension for a muzzleloading rifle, comprising: a barrel extension breech end for receiving a propellant charge, and a barrel extension muzzle end forming an extended attachment structure for receiving a complementary attachment structure of a barrel; and a chamber disposed within the barrel extension having a first diameter at the barrel extension breech end and a narrowing portion adjacent the barrel extension muzzle end, opposite the barrel extension breech end, the narrowing portion having a second diameter smaller than the first diameter; wherein the first diameter of the chamber is sized to receive the propellant charge therein, and the second diameter of the narrowing portion is sized to prevent the propellant charge from being further inserted past the narrowing portion.

The chamber may be integrally formed with the barrel extension, or formed within a bushing inserted into the barrel extension breech end. The bushing may be compress fitted within the chamber.

At least one sealing washer may be disposed at the barrel extension muzzle end, within an aperture formed by the extended attachment structure.

The barrel extension extended attachment structure includes threaded grooves, lug protrusions, or apertures to form an attachment structure with the barrel.

The barrel extension may further include the barrel extension breech end in mechanical communication with an extractor having an extractor projectile or protrusion, the extractor projectile or protrusion having an indentation or seating portion for receiving a rim of the propellant charge.

In a second aspect, the present invention is directed to a muzzleloading firearm comprising: a rifle frame; a barrel having a barrel breech end with a first attachment structure and a barrel muzzle end, and a barrel lug, the barrel lug in rotational communication with the rifle frame, the barrel muzzle end for receiving a projectile; a barrel extension having a barrel extension breech end and a barrel extension muzzle end, the barrel extension muzzle end having a second attachment structure to receive the first attachment structure of the barrel breech end, and the barrel extension breech end having a chamber to receive a propellant charge, wherein the chamber extends through the barrel extension from the barrel extension breech end to the barrel extension muzzle end; and the chamber further including a first diameter at the barrel extension muzzle end smaller than a largest diameter of the projectile, such that loading the projectile into the barrel from the barrel extension breech end, or inserting the projectile into the chamber from the barrel muzzle end is physically prohibited, and the chamber including a second diameter at the barrel extension breech end for receiving the propellant charge, the first diameter being smaller than a largest diameter of the propellant charge, such that the propellant charge is physically prohibited from entering the barrel through the chamber.

The muzzleloading firearm may include an extractor having an extractor protrusion at one end, the extractor protrusion formed to receive a portion of a rim of the propellant charge and disposed directly adjacent to and underneath the barrel extension, the extractor in slideable engagement with respect to the barrel lug, the extractor and the barrel extension breech end forming a cavity to receive the rim of the propellant charge.

The barrel lug is disposed directly adjacent to and underneath the extractor, such that the extractor slides back and forth between a retracted position that allows for full reception of the propellant charge into the barrel extension, and an extended position for extracting the propellant charge.

The muzzleloading firearm may be a break-open action firearm.

The rifle frame includes a recess shaped for receiving an end portion of a propellant charge when the break-open action firearm is rotated to a closed, firing position. The recess includes an angled portion for allowing sufficient clearance for the end portion of the propellant charge.

In a third aspect, the present invention is directed to a bolt action rifle comprising: a rifle frame receiver; a barrel centered about a longitudinal axis having a barrel breech end with a first attachment structure and a barrel muzzle end, the barrel muzzle end for receiving a projectile; a barrel extension having a barrel extension breech end and a barrel extension muzzle end, the barrel extension muzzle end having a second attachment structure to receive the first attachment structure of the barrel breech end, and the barrel extension breech end having a chamber to receive a propellant charge, wherein the chamber extends through the barrel extension from the barrel extension breech end to the barrel extension muzzle end; the chamber further including a first diameter at the barrel extension muzzle end smaller than a largest diameter of the projectile, such that loading the projectile into the barrel from the barrel extension breech end, or inserting the projectile into the chamber from the barrel muzzle end is physically prohibited, and the chamber including a second diameter at the barrel extension breech end for receiving the propellant charge, the first diameter being smaller than a largest diameter of the propellant charge, such that the propellant charge is physically prohibited from entering the barrel through the chamber; a rotatable, slideable bolt supported by the rifle frame receiver, the bolt centered about the longitudinal axis, and adjacent the barrel extension breech end, the bolt having a first end with a handle and a second end with a bolt head, such that the bolt may be rotated, pulled, and pushed along the longitudinal axis via the handle, the bolt head proximate the barrel extension breech end; and a firing pin disposed within the bolt head extending from an axial center of the bolt head and in alignment with the longitudinal axis when in a firing configuration to engage a primer on a propellant charge, such that the firing pin moves between a normal/disengaged position where a tip of the firing pin is fully receded back into the bolt head, and a firing/engaged position where the tip of the firing pin is pushed forward towards the primer.

The bolt action rifle may include a magazine for holding the plurality of propellant charges, the magazine releasably attachable to, and disposed underneath, the rifle frame receiver, the magazine having a spring-loaded base for applying a constant insertion force on the propellant charges into the rifle frame receiver.

A primer recess or cavity is presented within the bolt head, the recess or cavity disposed on a face of the bolt head proximate the barrel extension, the primer recess having an aperture therein for receiving the tip of the firing pin, and secures a primer of a propellant charge once the propellant charge is fully loaded into the barrel extension.

In a fourth aspect, the present invention is directed to a bolt action rifle comprising: a rifle frame receiver; a barrel centered about a longitudinal axis having a barrel breech end with a first attachment structure and a barrel muzzle end, the barrel muzzle end for receiving a projectile; a barrel extension having a barrel extension breech end and a barrel extension muzzle end, the barrel extension muzzle end having a second attachment structure to receive the first attachment structure of the barrel breech end, and the barrel extension breech end having a chamber to receive a propellant charge, wherein the chamber extends through the barrel extension from the barrel extension breech end to the barrel extension muzzle end; the chamber further including a first diameter at the barrel extension muzzle end smaller than a largest diameter of the projectile, such that loading the projectile into the barrel from the barrel extension breech end, or inserting the projectile into the chamber from the barrel muzzle end is physically prohibited, and the chamber including a second diameter at the barrel extension breech end for receiving the propellant charge, the first diameter being smaller than a largest diameter of the propellant charge, such that the propellant charge is physically prohibited from entering the barrel through the chamber; and a slideable bolt assembly supported by the rifle frame receiver, and adjacent the barrel extension breech end, the bolt assembly having a rotatable handle in mechanical communication with a bolt, the bolt having at one end a bolt head with a bolt face, the bolt head proximate the barrel extension breech end, the bolt situated along or parallel with the longitudinal axis, wherein the handle is rotated and the bolt is pulled and/or pushed along the longitudinal axis.

The bolt action rifle includes a firing pin disposed within the bolt head extending from an axial center of the bolt head and in alignment with the longitudinal axis when in a firing configuration to engage a primer on a propellant charge, such that the firing pin moves between a normal/disengaged position where a tip of the firing pin is fully receded back into the bolt head, and a firing/engaged position where the tip of the firing pin is pushed forward towards the primer.

In at least one embodiment, the bolt does not rotate when the bolt handle is rotated.

The barrel extension includes a gap or notch on its breech end and an extractor in mechanical communication with the bolt, the gap or notch receiving the extractor when the extractor is pushed towards the barrel extension, the extractor being pulled and/or pushed in a direction parallel to the longitudinal axis along with the bolt via the handle, but not rotated.

The bolt may include an ejector component biased towards the barrel extension breech end in a direction perpendicular to the bolt face, and parallel with the longitudinal axis.

In a fifth aspect, the present invention is directed to a method of loading a muzzleloading rifle, comprising: providing a propellant charge including a propellant charge case with a propellant disposed therein, a rim, a primer, and a cap end; providing a projectile separate from the propellant charge and having a projectile diameter; providing a barrel having a length, a longitudinal axis, a barrel breech end with a barrel attachment structure, and a barrel muzzle end for receiving the projectile; providing a barrel extension along the longitudinal axis, the barrel extension further having a barrel extension breech end, a barrel extension muzzle end with a barrel extension attachment structure, the barrel extension attachment structure complementary to the barrel attachment structure, the barrel extension having a chamber therethrough such that on the barrel extension breech end the chamber receives the propellant charge, the chamber having a narrowing section exposed on the barrel extension muzzle end, the narrowing section having a diameter less than that of the projectile diameter, such that the barrel breech end is received in the barrel extension muzzle end, the barrel and the barrel extension being coaxial about the longitudinal axis, and the barrel extension being removably attached to the barrel; providing a rifle frame; providing at least one sealing washer disposed between the barrel extension muzzle end and the barrel breech end; securing the barrel to the barrel extension with the at least one sealing washer therebetween; breaking open the rifle by rotating a barrel lug about the rifle frame to expose the chamber within the barrel extension; inserting the propellant charge into the barrel extension breech end within the barrel extension chamber such that the cap end of the propellant charge is inserted first, and the propellant charge rim sits at least partially flush with an edge of the barrel extension breech end to indicate full insertion into the chamber; closing the rifle by rotating the barrel lug with respect to the rifle frame; and pushing the projectile into the barrel muzzle end and through the length of the barrel until stopped from further movement by the barrel extension chamber narrowing section.

In a sixth aspect, the present invention is directed to a method of loading a muzzleloading bolt action rifle, comprising: providing at least one propellant charge having a rim, a cap, and a propellant disposed therein, and a projectile having a projectile diameter, such that the projectile is separate and distinct from the propellant charge; providing a barrel having a length, a longitudinal axis, a breech end, and a muzzle end, the muzzle end have a sufficient diameter size for receiving the projectile; providing a rifle frame supporting the barrel and a barrel extension thereon, and a receiver for supporting a bolt thereon; providing the barrel extension releasably attachable to the rifle frame on a barrel extension breech end, and releasably attachable to the barrel on a barrel extension muzzle end, such that the barrel and the barrel extension are coaxial, sharing the longitudinal axis, the barrel extension further having a chamber therethrough for receiving the at least one propellant charge, the chamber having a narrowing zone with a diameter less than that of the projectile diameter; providing a bolt assembly having a bolt and a bolt handle, the bolt centered about the longitudinal axis, supported by the receiver, and adjacent the barrel extension, the bolt having a first end with the bolt handle and a second end terminating with a bolt head, such that the bolt may be pulled and pushed along the longitudinal axis via the handle; pushing the projectile into the barrel muzzle end and through the length of the barrel until stopped from further movement by the narrowing zone; rotating the handle and pulling back the bolt via the handle to expose the barrel extension breech end and create a gap between the bolt head and barrel extension sized for fitting the at least one propellant charge; and using the bolt, via the bolt handle, to push the propellant charge into the barrel extension chamber, such that the cap end of the propellant charge is inserted first, and the bolt head stops adjacent to the barrel extension first end to indicate full insertion of the propellant charge into the chamber.

The method including providing a magazine for holding the at least one propellant charge, the magazine releasably attachable to, and disposed underneath, the rifle frame;

In a seventh aspect, the present invention is directed to a bolt action rifle having a bolt action assembly, the bolt action assembly comprising: a receiver; a bolt body in slidable communication with the receiver, the bolt body having a first portion with a first diameter and a second portion with a second diameter, the second diameter less than the first diameter, wherein the first and second bolt portions form a step at a junction where the first and second bolt portions meet, the bolt first portion having an exposed bolt face and an aperture for receiving a firing pin tip, the bolt second portion having an attachment mechanism on an end opposite the bolt face; a bolt lever attached to or integral with a bolt casing, wherein the bolt casing includes an annual ring portion insertable around and coaxial with the bolt second portion such that the bolt casing and bolt lever are rotatable about the bolt second portion without rotating the bolt second portion, and the bolt lever and bolt casing are in slidable communication with the bolt second portion and the receiver; a firing pin insertable within and in slidable communication with the bolt, the firing pin having the firing pin tip at an end proximate the bolt face; a resilient mechanism applying a bias force to the firing pin when the bolt lever and bolt casing are held forward in a closed, firing position, the bias force pushing the firing pin towards the bolt face; and a plug attached to the bolt second portion at the attachment mechanism, the plug providing a mechanical stop or the resilient mechanism.

The bolt first portion includes a slot or aperture for housing an extractor mechanism proximate the bolt face.

The extractor mechanism includes an extractor lever having a hook or protrusion on a first end, a second end opposite the first end in mechanical communication with a biasing resilient component, a protruding aperture situated between the first and second ends, and a pivot pin insertable within the bolt and the protruding aperture, the pivot pin allowing the extractor mechanism to pivot away from and towards the bolt.

The bolt first portion may include an ejector mechanism for dislodging a propellant charge from the bolt face after firing.

In one embodiment, the ejector mechanism includes a slot within the bolt first portion and an ejector slidable therein, such that the ejector is biased forward beyond the bolt face when the bolt first portion is pulled back in a direction opposite a muzzle end of the muzzleloading rifle.

In a second embodiment, the ejector mechanism includes an ejector pin located within an aperture accessible on the bolt face, the ejector pin biased forward in a direction beyond the bolt face by a resilient mechanism, and having an indentation for receiving a set pin such that the ejector pin slidable path towards and away from the bolt face is restricted by the set pin between the indentation.

The set pin is insertable within the bolt first portion in a direction perpendicular to the ejector pin motion.

The receiver may include an aperture through which propellant charges may be loaded or unloaded, and a slot to receive a bolt handle proximate the aperture, such that the bolt handle, by fitting into the slot, puts the bolt action in the CLOSED position, ready for firing.

The bolt action rifle may include a trigger housing having a rectangular aperture for receiving a magazine.

A magazine retainer mechanism may be provided which includes a magazine retaining lever, a biasing spring, and a pivot structure for biasing the magazine retaining lever towards the magazine. The magazine includes a slot for receiving a portion of the magazine retaining lever to secure the magazine.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 26A is a cross-sectional view of the barrel and barrel extension attached to a receiver;

FIG. 26B is a cross-sectional view of the receiver of FIG. 26A with an exposed aperture for ejection of the propellant charge;

DESCRIPTION OF THE EMBODIMENT(S)

In describing the embodiment(s) of the present invention, reference will be made herein to FIGS. 1-38 of the drawings in which like numerals refer to like features of the invention.

Figure 1:
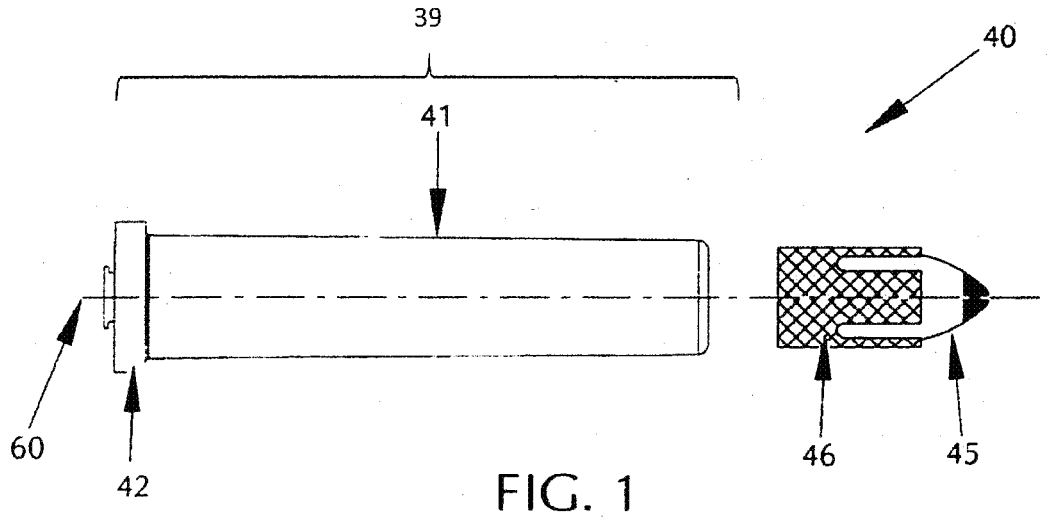
FIG. 1 is a side elevational view of ammunition components used with the present invention.
Figure 2:
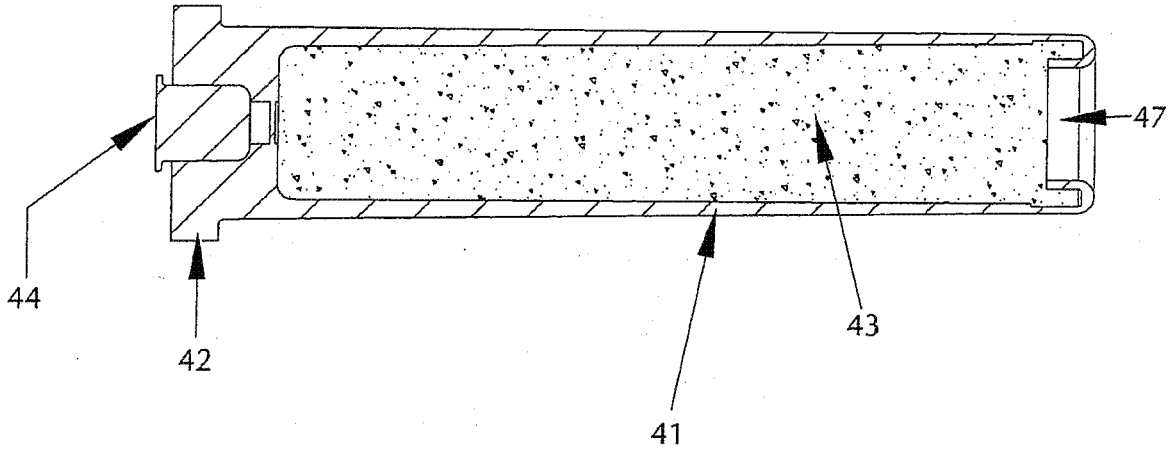
FIG. 2 is a side cross-sectional view of the propellant charge of FIG. 1.

FIGS. 1-2 depict ammunition components 40 as described herein includes a propellant charge 39, which includes a propellant charge case 41 encasing a propellant 43 therein, and primer 44. The propellant charge case 41 is shaped in a hollow cylindrical structure, as shown in FIGS. 1-2. One end of the propellant charge case 41 has a rim 42 with a diameter larger than that of the propellant charge case diameter. Primer 44 is disposed along the axial center of the rim 42. The inside of the propellant charge case 41 holds the ignitable powder or charged propellant 43, which is sealed within the propellant charge case 41 via the rim 42 and a cap 47 disposed on the distal end of the propellant charge case 41 opposite the rim 42. Ammunition components 40 further include a bullet or projectile 45, which may include a sabot or gas check 46, wherein the projectile 45 is axially disposed within the sabot 46 such that they are coaxial along a center longitudinal axis. Optionally, bullet or projectile 45 may be used with the muzzleloading rifles of the present invention without a conjoining sabot 46. Projectile 45 and sabot 46 are separate from the propellant charge structure 39 shown in FIGS. 1-2, but complete the ammunition component structure 40 when properly loaded into the rifle embodiments of the present invention as described in greater detail below.

The unique design of this propellant charge 39 provides for greater shot consistency due to the pre-determined amount of propellant 43 provided within the propellant charge case 41, which also facilitates cleaning of the rifle.

Break Action Rifle

Figure 3:
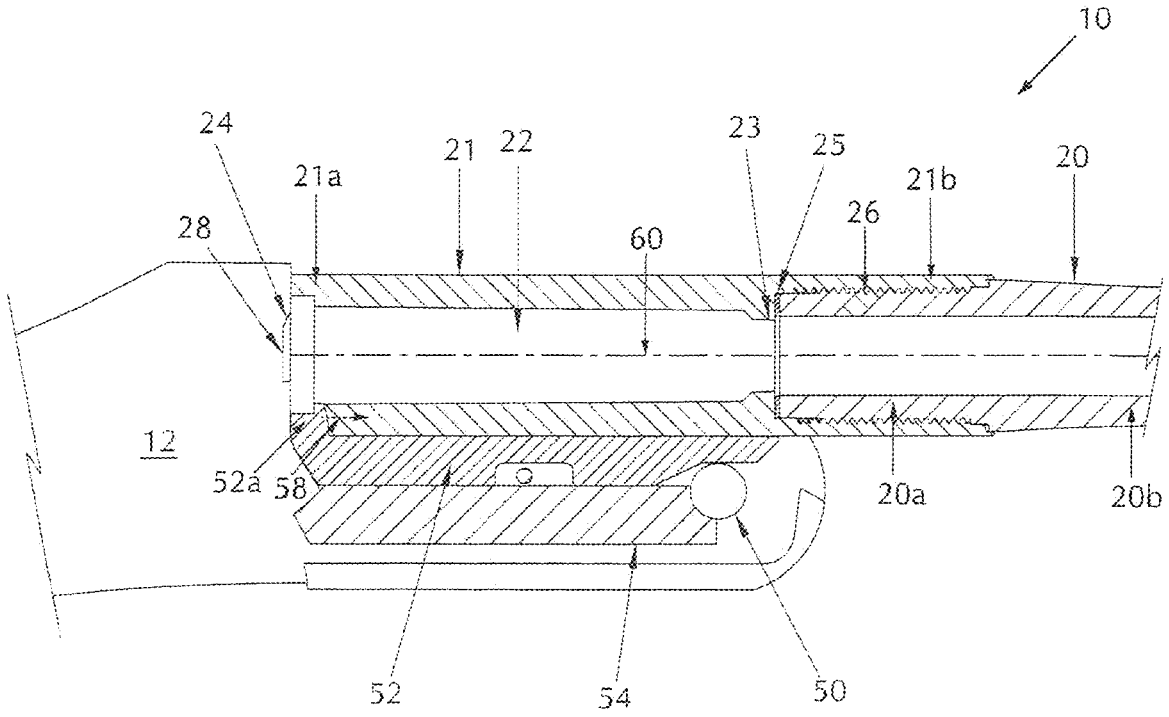
FIG. 3 is a partial side cross-sectional view of a break action rifle embodiment of the present invention.
Figure 4:
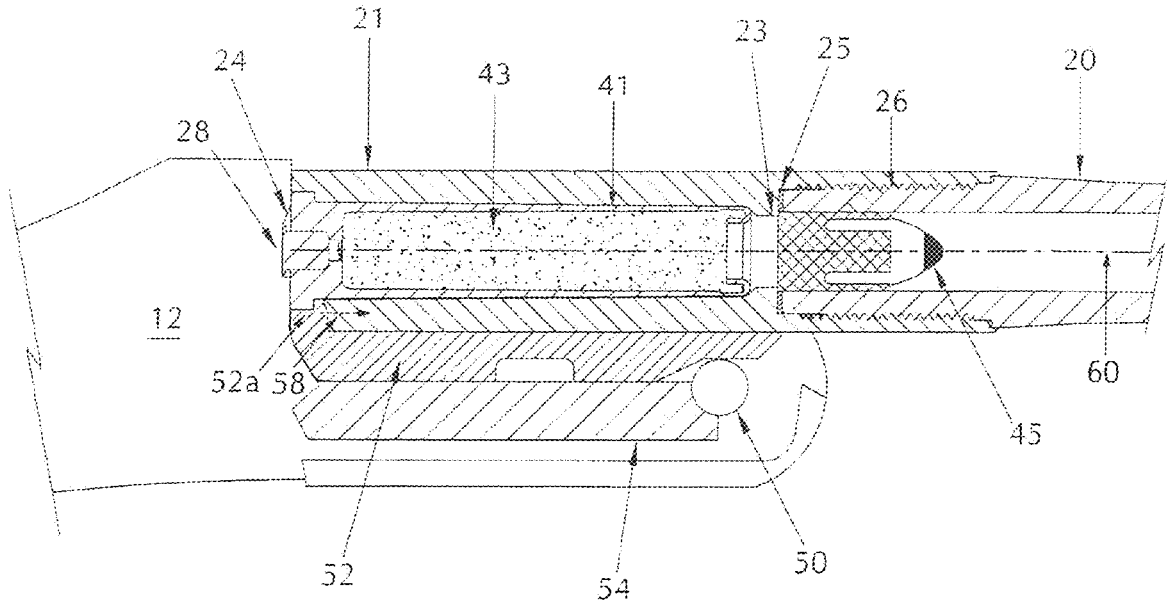
FIG. 4 is a partial side cross-sectional view of the break action rifle of FIG. 3 loaded with ammunition.

FIG. 3 is a partial side cross-sectional view of a break action rifle embodiment of the present invention. A muzzleloading break action rifle 10 of the present invention presents a frame 12, a portion of a barrel 20 having a first or breech end 20*a* and a second or muzzle end opposite the breech end 20*a*, hereinafter referred to as item 20*b*. (FIG. 3 does not extend the barrel to the complete length, thus for illustrative purposes only, barrel muzzle end 20*b* is identified at the end of the barrel shown in the drawing.) A barrel extension 21 is coaxial with barrel 20 (i.e. sharing a longitudinal axis 60), the barrel extension 21 having a first or breech end 21*a* and second or muzzle end 21*b* opposite the barrel extension breech end 21*a*, as shown in FIGS. 3-4. FIG. 4 is a partial side cross-sectional view of the break action rifle of FIG. 3 loaded with ammunition.

The barrel 20 is received by the barrel extension 21 via an attachment structure, such as complementary threads, protrusions, or apertures, and, for illustrative purposes, shown in the figures as a threaded connection between the barrel breech end and barrel extension muzzle end (shown as engaging threads 26 in FIGS. 3-6). The barrel 20 having a complementary attachment structure to mate with barrel extension 21. The barrel 20 and barrel extension 21 may be connected by other means, such as compression fit, welding, lug bolts, and adhesive, to name a few, although a detachable barrel is the preferred embodiment. This design allows for a muzzleloading break action firearm to accept interchangeable barrels.

Figure 5:
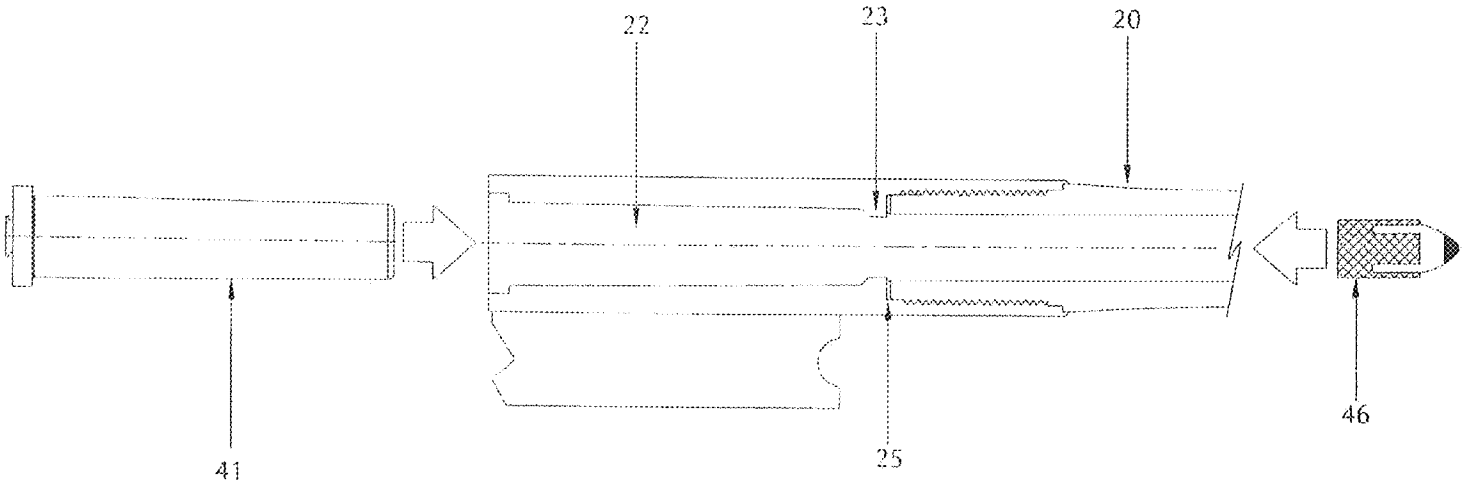
FIG. 5 is a side cross-sectional exploded view of the ammunition components, barrel, and barrel extension of the break action rifle of FIG. 3.

FIG. 5 is a side cross-sectional exploded view of the ammunition components, barrel, and barrel extension of the break action rifle of FIG. 3.

A sealing washer 25 is disposed between the barrel breech end 20*a* and barrel extension 21. As will be discussed in further detail below, sealing washer 25 sits on an annular base internal to the barrel extension proximate the breech-most extension of threads 26. The sealing washer ensures threaded connection 26 is not exposed to hot combustion gasses during firing, which could otherwise compromise the attachment structure between the barrel extension and the barrel.

This barrel/barrel extension combination is unique over the prior art muzzleloader designs in that the barrel extension 21 provides for a separate machined device, removes the barrel from additional manufacturing process steps, allows for the formation of a receiving chamber for a propellant charge, such that the receiving chamber is separate from the barrel, and receives barrel 20 in a sealing fashion that protects the attachment structure, here shown as a threaded connection. The barrel extension 21 of the present invention is adjacent the rifle frame, and connects with the barrel at the barrel breech end 20*a*, and serves as the accessible breech component in the break action rifle operation. Furthermore, in one embodiment, barrel extension 21 serves as an external component to this assembly, meaning the threaded end of extension 21 has a larger diameter for receiving the breech end 20*a* of the barrel 20 therein, with breech end 20*a* having a corresponding smaller diameter. Thus, the outside surface of barrel extension muzzle end 21*b* is exposed to the user after assembly. This is contrary to most designs, where barrel extensions generally act as an internal component, meaning the barrel has the larger diameter threaded end and receives internally the barrel extension (with a smaller diameter threaded end). The latter design, however, could not accommodate an internal chamber in the barrel extension with a constricted bore leading to the barrel.

Figure 6:
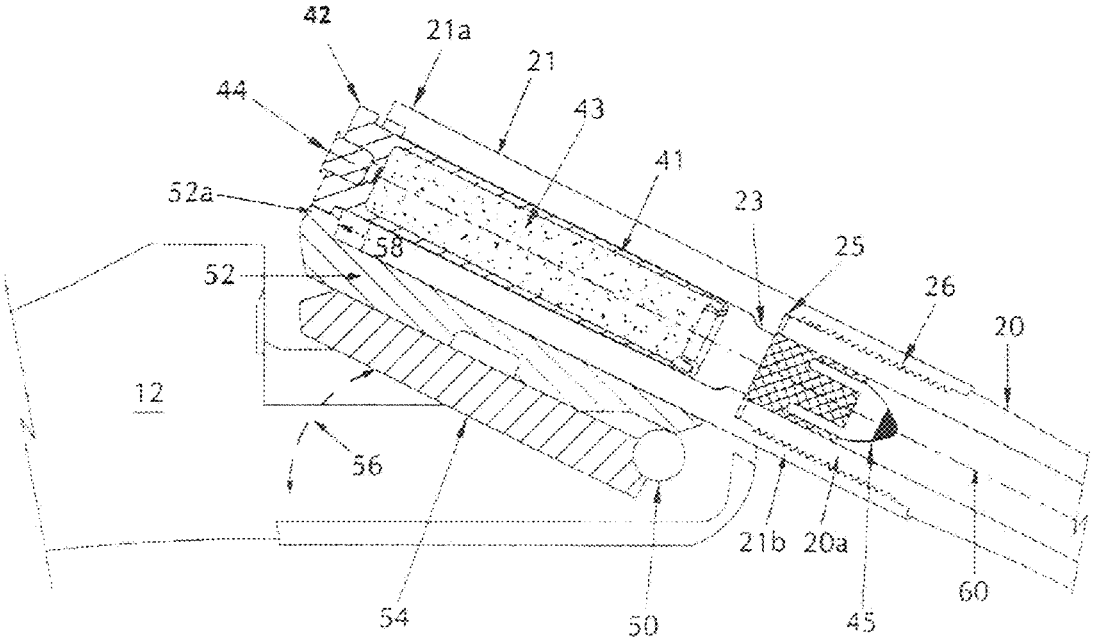
FIG. 6 is a partial side cross-sectional view of a portion of the break action rifle of FIG. 3 in the OPEN position with a portion of the barrel and frame shown to expose the chamber and the insertion of ammunition components within the barrel extension.

FIG. 6 is a partial side cross-sectional view of a portion of the break action rifle of FIG. 3 in the OPEN position with a portion of the barrel and frame shown to expose the chamber and the insertion of ammunition components within the barrel extension. An extractor 52 having a projection or protrusion 52*a* is in slidable communication with barrel extension 21. Projection or protrusion 52*a* extends inwards towards longitudinal axis 60 and the barrel extension 21 at the barrel extension breech end 21*a*. The extractor 52 is extended to receive a portion of rim 42 of the propellant charge 39, and in at least one embodiment is disposed directly adjacent to and underneath the barrel extension 21. A barrel lug 54 is disposed directly adjacent to and underneath the extractor 52. The extractor 52 slides into a retracted position towards barrel extension breech end 21*a* (in the direction of directional arrow 58*a* in FIGS. 3-4), and allows for full reception of the propellant charge 39 within chamber 22 located in, and accessible from, the breech end 21*a* of the barrel extension 21. The extractor 52 slides in a reverse direction to an extended position for extracting the propellant charge, sliding in the direction of directional arrow 58*b* in FIG. 6, parallel to the barrel's longitudinal axis 60.

Figure 7:
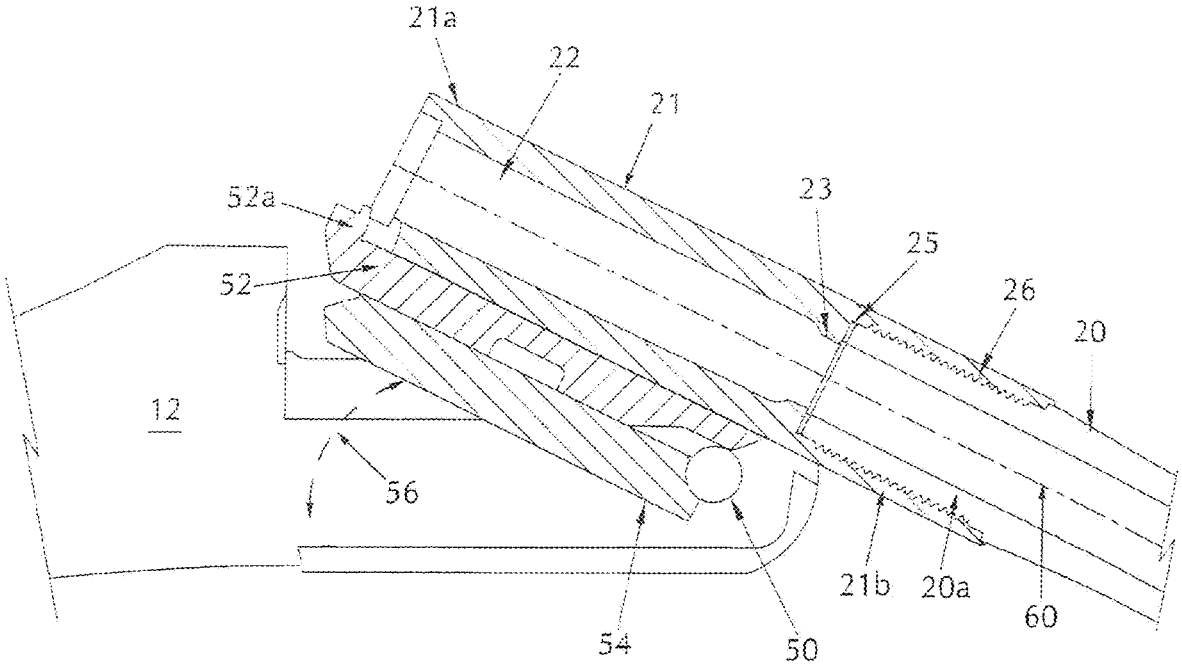
FIG. 7 is a partial side cross-sectional view of the broken open break action rifle of FIG. 6, without ammunition components in the chamber.

FIG. 7 is a partial side cross-sectional view of the broken open break action rifle of FIG. 6, without ammunition components in the chamber. A rotation axle 50 connecting the barrel lug 54 and rifle frame 12 is disposed proximate the end of the barrel lug, and allows for breaking action of the rifle, i.e., the rifle frame 12 and the combination of barrel lug 54 and barrel extension 21 rotating away from and towards each other in an arcing motion represented by arrow 56 and pivoting about axle 50 as shown in FIGS. 6-7 to expose the breech end 21*a* of the barrel extension to a user. This will allow the user to access the chamber 22 within the barrel extension 21 via the barrel extension breech end 21*a* for loading and unloading propellant charge 39. Conversely, pivot axis 50 may be located on the barrel lug, and an arcuate receiving structure may be on the rifle frame to allow for the rotation of the rifle frame with respect to the barrel lug to expose the breech end 21*a* of the barrel extension.

The chamber structure for receiving a propellant charge of the present invention is unique over the prior art in that prior art rifles have their chamber located directly within the barrel instead of a barrel extension. The current design removes additional machining steps to the barrel, thus ensuring barrel integrity, and allows for attachment to the frame 12 without additional barrel modification; for example, the barrel lug may be attached to the barrel extension rather than the barrel itself. This advantage also provides for easier cleaning of the chamber. Chamber 22 receives the propellant charge 39, which has a primer responsive to a striker or firing pin; thus, there is no need for a separate breech plug in the current muzzleloader design. Furthermore, the dimensional design prevents re-loading of a new propellant charge 39 into chamber 22 when the chamber 22 has not been properly emptied between shots (for example, if cap end 47 separated from the propellant charge case 41 after firing and remained within the chamber after the expended propellant charge case was removed).

The barrel extension 21 and the chamber 22 internally formed therein are directly adjacent rifle frame 12 upon installation, and are coaxial with barrel 20 along longitudinal axis 60. Chamber 22 of barrel extension 21 has a narrowing or constriction section 23 proximate the portion of the chamber 22 nearest the barrel extension muzzle end 21*b*, where the barrel 20 seats within the barrel extension 21. This narrowing section 23 forms an annular collar that has a diameter smaller than the diameter of chamber 22, propellant charge 41, and projectile 45 (and, if utilized with the projectile, sabot 46). Sealing washer 25 is disposed between the breech end 20*a* of barrel 20, and the annular collar formed by constriction section 23 on barrel extension 21, and is seated adjacent to this narrowing, constriction section 23, outside of the chamber 22, where barrel 20 seats within barrel extension 21. The sealing washer 25 provides the unique benefit of preventing combustion gasses from entering the complementary threads 26 of the barrel and barrel extension during firing.

To load the break action rifle 10, projectile 45, and sabot 46 if used, are inserted into the barrel 20 from muzzle end 20*b*, and pushed towards the barrel breech end 20*a* via a ramrod (not shown). The projectile and sabot will traverse down barrel 20 and stop at the breech end 20*a* adjacent the narrowing or constriction section 23, due in part to the smaller diameter of narrowing section 23. The bottom edge of projectile 45 or sabot 46 faces the narrowing constriction section 23, and projectile 45 is exposed towards the muzzle end 20*b* of barrel 20. Projectile 45 and sabot 46 are coaxial, and in longitudinal alignment with axis 60.

Once projectile 45 and sabot 46 are loaded into the barrel 20, the rifle frame 12 and barrel extension 21 are separated by break action (i.e., a rotational arcing separation about rotation axle or pivot 50, as demonstrated in FIGS. 6-7) to expose chamber 22 within barrel extension 21. Propellant charge 39 may then be inserted within chamber 22, such that the cap end 47 of the propellant charge 39 enters the chamber first and is prohibited from further insertion by the narrowing constriction section 23, and may also be prohibited from further insertion by a mechanical stop provided by the rim 42 meeting the breech end 21*a* of the barrel extension. Once the propellant charge 39 is fully inserted into the chamber 22, the barrel 20 is rotated back towards the rifle frame 12 in a closing arc motion about rotation axle or pivot 50 (as seen in FIGS. 6-7).

In order to accommodate this rotational motion, a portion of rifle frame 12 includes a carve out, slot, or primer recess 28, which receives a rotational primer 44 extending from the breech end of the propellant charge case 41. A ramp section 24 of primer recess 28, adjacent to the first end 21*a* of the barrel extension 21, may be included to facilitate receiving the extension of primer 44 in a rotational fashion as the break open rifle is configured from the OPEN position to the CLOSED position. The primer recess 28 and accompanying ramp section 24 are configured to receive primer 44 which extends from the flush surface of rim 42 and at least a portion of barrel extension breech end 21*a*. The ramp 24 is situated to receive primer 44 as the loaded rifle is closed to prepare for firing.

When the rifle is first broken open to expose the breech end 21*a* of barrel extension 21, extractor 52 pushes slightly away from the barrel extension 21 in the breech end direction depicted by arrow 58*b* to an extended position, as shown in FIG. 6. A user can then insert a propellant charge 39 into the chamber 22 up until the rim 42 of the propellant charge 39 is in contact with, and is adjacent to, the extractor projection or protrusion 52*a*. Protrusion 52*a* may be configured to form a seat for receiving rim 42. Once the propellant charge 39 is fully inserted, the user may then close the rifle and prepare for firing, as demonstrated in FIG. 3. Putting the break open rifle in a CLOSED position will initiate a retraction of the extractor 52 back into the retracted position in the direction of arrow 58*a*, where the extractor sits flush with the contours of extractor 52 and/or the breech end 21*a* of the barrel extension 21. The rim 42 of the propellant charge 39 will also sit flush with the extractor protrusion 52*a*. Upon rotation to the CLOSED position, primer 44 extends into the recess 28 formed within the frame 12. After firing, the user may then break open the rifle to its OPEN position which moves the extractor 52 into an extended position in the direction of arrow 58*b*, which simultaneously pushes out propellant charge 39 via the contact between the rim 42 and extractor protrusion 52*a*. Spent propellant charge 39 may then be replaced.

Chamber Embodiments

Figure 34:
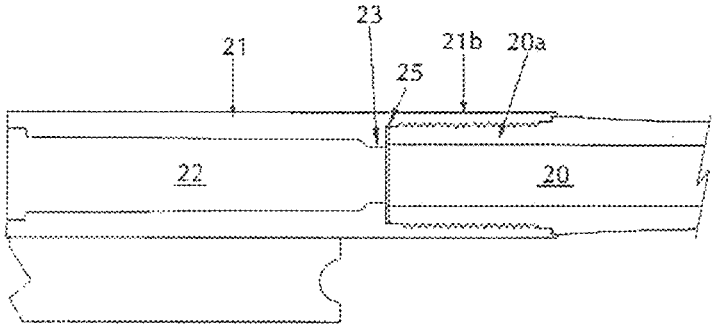
FIG. 34 presents an embodiment of the barrel extension for a break action rifle.
Figure 35:
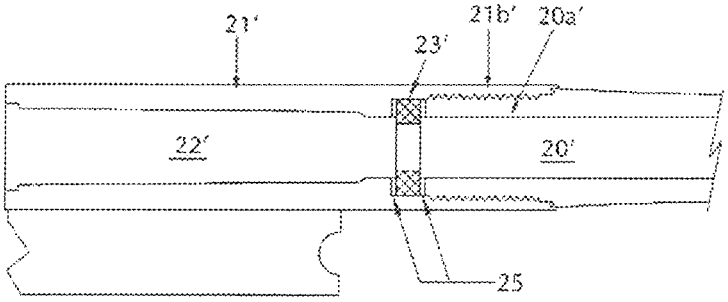
FIG. 35 presents an alternative embodiment for the barrel, extension, chamber, and narrowing section or portion.
Figure 36:
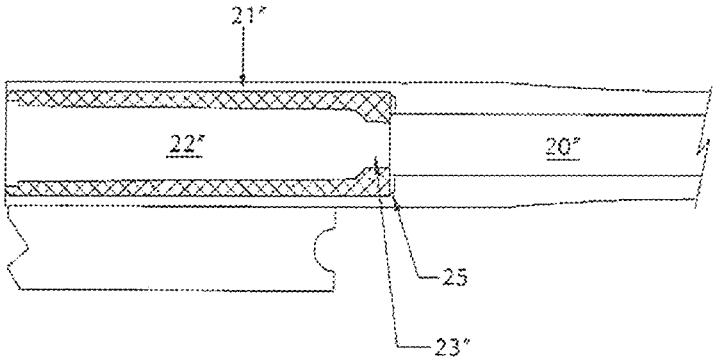
FIG. 36 presents another alternative embodiment of the barrel, extension portion, chamber, and narrowing section or portion.

Other embodiments of the chamber may be used with the break action or bolt action rifle embodiments of the present invention described above. FIGS. 34-36 present such alternate chamber embodiments 22, 22', 22", each of which are present within their respective barrel extensions 21, 21', 21". FIG. 34 presents the barrel extension 21, barrel 20, chamber 22, narrowing 23, and sealing washer 25 previously described above for the break action rifle.

FIG. 35 presents an alternative embodiment of the barrel 20', extension 21', chamber 22', and narrowing section or portion 23'. In this embodiment, narrowing section 23 is combined with a bushing, such that the bushing forms a predetermined narrowing section radius separate in diameter from, and preferably smaller than, said narrowing section diameter, and such narrowing with bushing 23' is straddled by at least one sealing washer, and preferably two sealing washers 25 disposed on either side of said narrowing with bushing 23'. The narrowing section 23 is disposed between barrel extension 21' and barrel 20 at their respective muzzle end 21*b'* and breech end 20*a'*.

FIG. 36 presents another alternative embodiment of the barrel 20", extension portion 21", chamber 22", and narrowing section or portion 23". In this embodiment, extension portion 21" may be formed and integral with barrel 20". Extension portion 21" is presented as having a bushing with a built-in chamber 22" disposed therein for receiving the propellant charge 39. One of the benefits of this embodiment is that the bushing 22" can be machined separately from the barrel and extension portion, allowing the bushing 22" to comprise a different material than the barrel and extension portion. Narrowing section 23" is disposed at the end of the bushing 22" adjacent to the barrel 20. One sealing washer 25 is disposed where the narrowing section 23" and barrel 20 meet.

Bolt Action Rifle

The bolt action rifle, as opposed to a break open action, is generally considered a more robust design insomuch as all the essential elements are in-line. When a bolt handle is operated (rotated), the bolt is unlocked from the receiver and pulled rearward to open the breech allowing a spent cartridge case to be extracted and ejected, the firing pin within the bolt is cocked (either on opening or closing of the bolt depending on the gun design) and engages the sear, then upon the bolt being pushed back, a new cartridge (if available) is loaded into the chamber, and finally the breech is closed tight by the bolt re-locking against the receiver. Most of the bolt-action designs use a rotating-bolt (or "turn-pull") design, which involves the shooter doing an upward "rotating" movement of the bolt handle to unlock the bolt from the breech and cock the firing pin, followed by a rearward "pull" to open the breech, extract the spent cartridge case, then reverse the whole process to chamber the next cartridge and relock the breech.

In a straight bolt action design, the manipulation required from the user in order to chamber and extract a cartridge predominantly consists of a linear motion only, as opposed to a traditional rotating-bolt action where the user has to manually rotate the bolt for chambering and primary extraction. Therefore, in a straight-pull action, the bolt can be cycled back and forward without rotating the handle.

Unlike a break open design, a bolt action configuration lends itself to possible inclusion of a magazine capable of containing several propellant charges, which facilitates the changing or reloading process. One detriment to introducing a bolt action to interact with the propellant charge described above is that the dimensions of the propellant charge require a bolt with large bolt lugs at the bolt head. This complicates the bolt head design, and forces the use of larger diameter components, which in turn compels the receiver to increase in size. Thus, in different embodiments, the present invention considers a design in which the diameters of the bolt and bolt head are close to the diameter of the propellant charge. In such a design, the position of the bolt lugs is altered. As will be discussed in further detail herein, bolt lugs are moved to the back of the bolt assembly, preferably on the bolt handle.

A muzzleloading bolt action rifle 100 is presented in FIGS. 8-13, having a receiver 14, a barrel 120, and a barrel extension 121 extending longitudinally from the receiver. It should be noted that the illustrative embodiments for the bolt action rifle are shown using a muzzleloading rifle; however, the salient features of the present invention are not limited to muzzleloading rifles only, and may be applied to other non-muzzleloading bolt action rifles.

Figure 8:
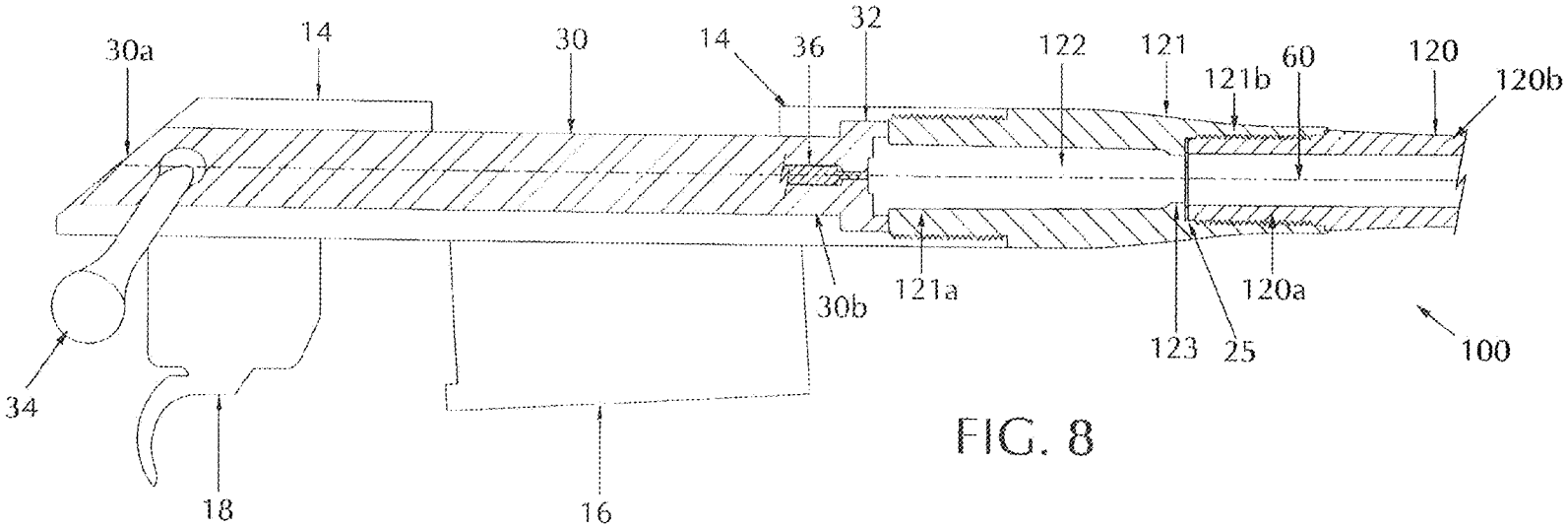
FIG. 8 is a partial side cross-sectional view of a bolt action rifle embodiment of the present invention.
Figure 9:
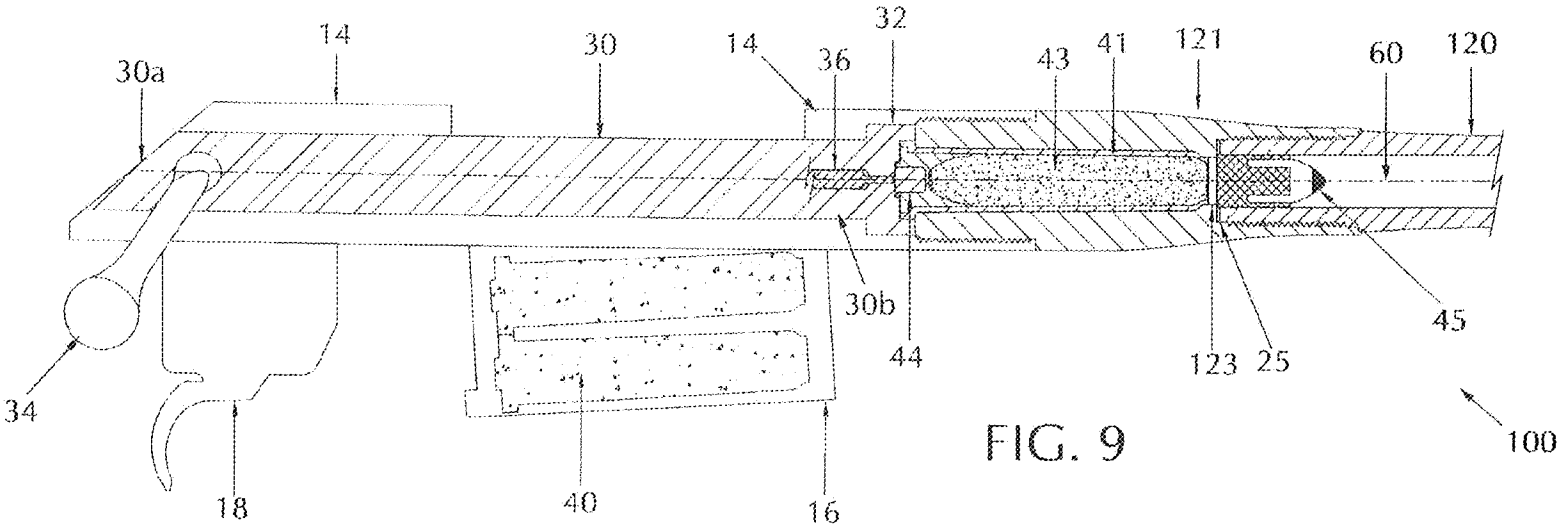
FIG. 9 is a side cross-sectional view of the bolt action rifle of FIG. 8 loaded with ammunition components.

FIG. 8 is a partial side cross-sectional view of an unloaded bolt action rifle embodiment of the present invention. FIG. 9 is a side cross-sectional view of the bolt action rifle of FIG. 8 loaded with ammunition components.

A trigger 18 is disposed beneath the receiver 14. A magazine 16 for holding propellant charge 39 is optionally disposed beneath, connected to, and supported by, the receiver 14 and situated forward trigger 18 in a direction closer to the muzzle end. A bolt assembly having a bolt 30 is disposed within the receiver 14 in longitudinal alignment with the barrel 120 and barrel extension 121.

Barrel 120 has a first or breech end 120*a*, and a second or muzzle end 120*b* for receiving the projectile as described above. Barrel extension 121 has a first or breech end 121*a*, and a second or muzzle end 121*b* for receiving the breech end 120*a* of the barrel 120. Barrel 120 and barrel extension 121 are connected preferably via a threaded connection, although other attachment structures and schemes are not prohibited. The barrel 120 and barrel extension 121 may be connected by other means, such as compression fit, welding, adhesive, lugs and grooves, and the like. A sealing washer may be disposed between the barrel extension 121 and barrel 120.

Barrel extension 121 has a chamber 122 disposed therein and traversing from the barrel extension breech end 120*a* to the barrel extension muzzle end 120*b*. At the point where the breech end of barrel 120 is firmly seated in barrel extension 121, the diameter of the chamber 122 is constricted and is smaller than the diameter of the chamber at the breech end 121*a* of barrel extension 121. In this regard, chamber 122 has a predetermined narrowing portion 123. The diameter of narrowing portion 123 is sized to prevent the propellant charge 39 from being pushed past this point (entering from breech end 121*a*), and to prevent projectiles 45 with or without sabots 46 from being inserted past the breech end 120*a* of barrel 120 and into the chamber 122 (entering initially from the barrel muzzle end).

Figure 10:
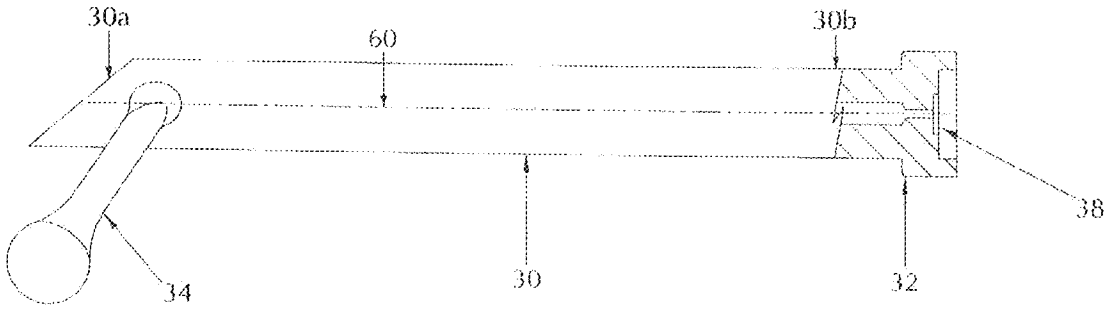
FIG. 10 is a side, partially cross-sectional view of an embodiment of a bolt used with the bolt action rifle of FIG. 8.

In an embodiment for a bolt action rifle, the bolt assembly includes a bolt 30 with a bolt handle 34 disposed on a first end 30*a* of bolt 30, and a bolt head 32 disposed on a second end 30*b* of bolt 30, adjacent to the barrel extension 121. FIG. 10 is a side, partially cross-sectional view of an embodiment of a bolt used with the bolt action rifle of FIG. 8.

Figure 11:
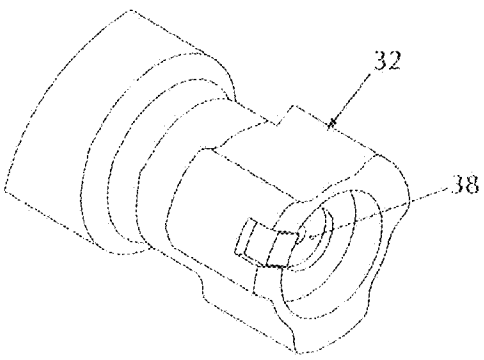
FIG. 11 is a perspective view of the bolt head of the bolt of FIG. 10.

A firing pin 36 is disposed at least partially within the bolt head 32, aligned along the axial center of the bolt head 32 and in longitudinal alignment with axis 60. Bolt head 32 further presents a primer recess 38 disposed on its face opening to the barrel extension 121. The base of primer recess 38 includes an aperture for allowing the tip of the firing pin 36 to move from within bolt 30 to a position extending into primer recess 38. FIG. 11 is a perspective view of the bolt head of the bolt of FIG. 10 depicted the primer recess.

Figure 13:
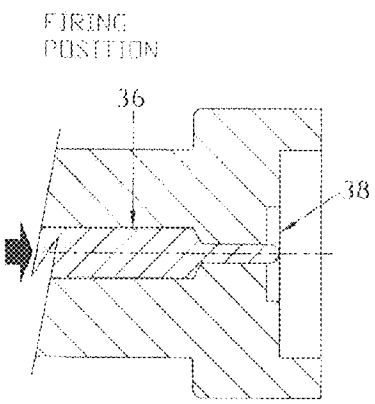
FIG. 13 is a side cross-sectional view of the bolt head of the bolt of FIG. 10 with the firing pin engaged.
Figure 12:
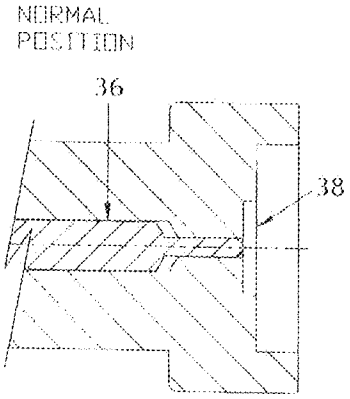
FIG. 12 is a side cross-sectional view of the bolt head of the bolt of FIG. 10 with the firing pin disengaged.

Primer recess 38 secures the primer 44 of the propellant charge 39 once it is fully loaded into the barrel extension 121. Firing pin 36 engages the primer 44 once the trigger 18 is activated to initiate the firing sequence. Firing pin 36 moves between a normal/disengaged position as shown in FIG. 12, where the head of the pin 36 is fully receded back into the bolt head 32, to a firing/engaged position as shown in FIG. 13, where the head of the pin 36 is pushed forward into recess 38 and in order to contact primer 44 disposed therein.

A feature of the bolt action rifle 100 of the present invention is the ability for a user to eject an expended propellant charge 39 and chamber a new propellant charge 39 into the barrel extension chamber 122 using only the bolt assembly. Once a propellant charge 39 is expended and its corresponding bullet or projectile 45 has been fired, the user may pull back on the bolt 30 using the handle 34, which will effectuate an ejection of the expended propellant charge 39. At this point, a new projectile 45 and/or projectile/sabot 46 may be loaded into the barrel 120 through the barrel's muzzle end and via a ramrod (not shown). (As is typical of safety measures, it is anticipated that a user would load the bullet 45 into the barrel 120 first before loading a new propellant charge 39 into the chamber 122.) Once the expended propellant charge is fully discharged, if a magazine is utilized, a new propellant charge 39 is pushed up through the magazine 16 into a chamber aligned with the longitudinal axis 60 bolt 30, which may then be pushed forward again via the handle 34 to load the chamber 122 with the new propellant charge 39. A fully inserted propellant charge 39 will fill the chamber 122, and the rim 42 will sit flush within the recess of the bolt head 32 (as shown in FIG. 11), with primer 44 disposed within primer recess 38.

Figure 14:
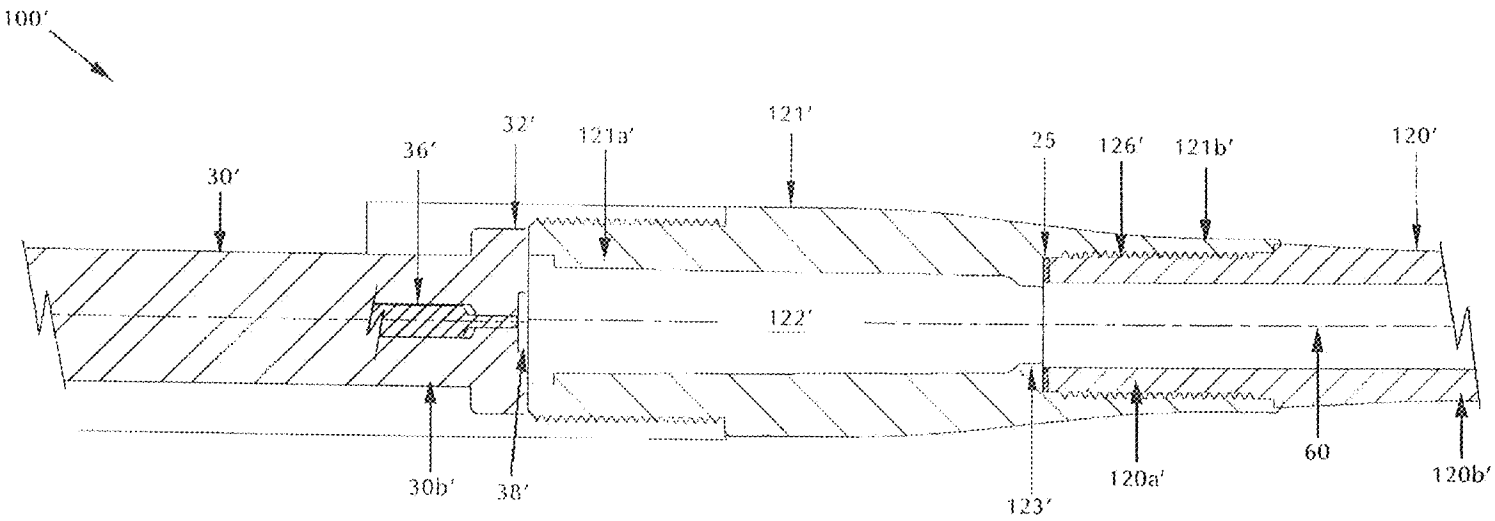
FIG. 14 is a partial side cross-sectional view of an alternate embodiment of a bolt action rifle of the present invention.

FIG. 14 presents an alternate embodiment of a bolt action rifle bolt assembly 100' presenting a bolt 30', a barrel extension 121', and a barrel 120' in longitudinal alignment along axis 60'. Barrel 120' has a breech end 120*a*', and a muzzle end 120*b*' for receiving a projectile as described above. Barrel extension 121' has a breech end 121*a*', and a muzzle end 121*b*' for receiving the breech end 120*a*' of the barrel 120'. Barrel 120' and barrel extension 121' are preferably connected via a threaded connection; however, the barrel 120' and barrel extension 121' may be connected by other means, such as compression fit, welding, lug bolts, adhesive, and the like. When in a firing configuration, the barrel extension 121' muzzle end is adjacent to, and in mechanical communication with, the breech end of barrel 120'. A sealing washer 25' is disposed between the extension 121' and barrel 120' via compression fit, welding, adhesive, or the like.

Barrel extension 121' has a chamber 122' disposed therein and expanding from its first end 120*a*' to its second end 120*b*'. At the point where the barrel 120' and barrel extension 121' connect, the diameter of the chamber 122' is reduced into a narrowing or constricted portion 123'. The diameter of narrowing portion 123' is sized to prevent propellant charge 39 from being inserted past this portion (entering from the breech end 121*a*') into the barrel breech end, and to prevent projectiles 45 with or without projectile/sabots 46 from being pushed past the barrel and into the chamber 122' (entering from the barrel extension muzzle end 121*b*').

The bolt assembly's bolt 30' presents a handle at a first end and a bolt head 32' at a muzzle end 30*b*' of the bolt 30' adjacent barrel extension 121'. A firing pin 36' is disposed within the bolt head 32' extending from the axial center of the bolt head 32' and in longitudinal alignment with axis 60'. Bolt head 32' is substantially flat on its face that is proximate to and contacts barrel extension 121' when in firing configuration with the exception that an annular collar is formed by a primer recess 38' indented within and disposed at the axial center of bolt head 32'. Primer recess 38' has chamber 35' for securing firing pin 36'. Chamber 35' is formed with an aperture 37' for securing the tip of the firing pin 36', such that aperture 37' extends to primer recess 38', which secures primer 44 of the propellant charge 39 once fully loaded into the barrel extension 121'. Firing pin 36' engages primer 44 when a trigger (not shown) is pulled to initiate the firing sequence. Firing pin 36' moves between a normal/disengaged position where the head of the firing pin 36' is fully receded back into chamber 35' and aperture 37' of bolt head 32', and to a firing/engaged position where the head of firing pin 36' is pushed forward towards propellant charge 41, into recess 38' (and thus contacts primer 44 disposed therein).

The chambering of propellant charge 39 in this bolt action rifle 100' is substantially similar to that described above in the prior embodiment. In this bolt action assembly 100', however, a propellant charge 39 inserts completely within the chamber 122' such that the rim 42 of the propellant charge 39 sits flush with the rear edge of the breech end 121*a*' of barrel extension 121'. In this manner, only primer 44 extends into the bolt head 32' primer recess cavity 38'.

In either bolt-action embodiment discussed above, the extraction of the propellant charge is challenging and difficult. In one instance, the rim of the propellant charge is exposed, but sits flush against the breech end of the barrel extension (see FIG. 9). In a second instance, the rim of the propellant charge is fit within a formed cavity of the breech end of the barrel extension, and an outward extension of the primer is exposed (see FIG. 14). In both cases, the design of an extractor for the propellant charge must accommodate these deficiencies.

The propellant charge identified herein was initially designed for break open firearms. The larger rear tab (rim diameter) of the propellant charge necessarily enlarges the width of the rifle. In a bolt action design, this would require a rifle size unsuitable for sporting activities. Moreover, the flush design of the propellant charge against the barrel (or barrel extension) requires some form of extraction to remove.

As noted previously, the propellant charge is designed to fit within a chamber. The propellant charge is fully inserted in a chamber such that there are no areas of the propellant charge exposed outside the chamber which would make the propellant charge vulnerable to expanding gas pressure. For this reason, an extractor 52 facilitates removal. The extractor rests firmly on the propellant charge rim 42.

Figure 15A:
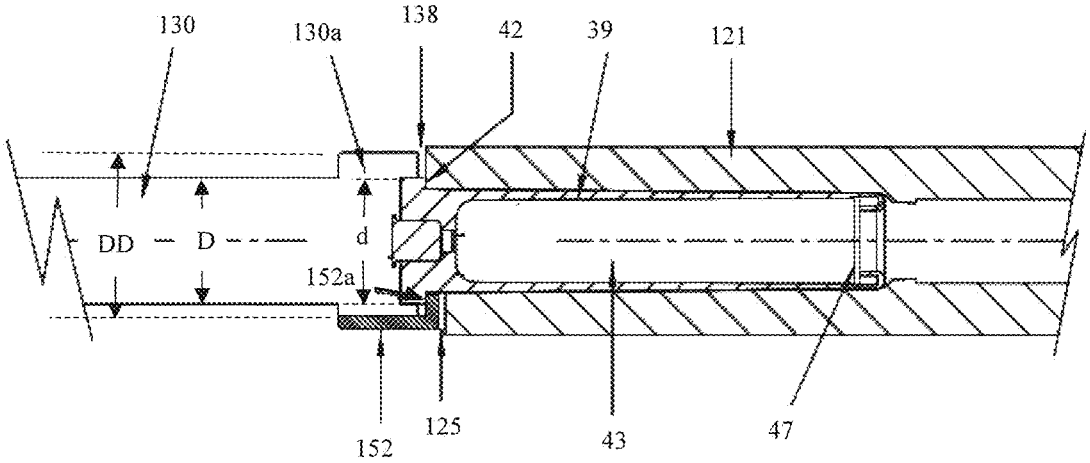
FIG. 15A depicts a partial cross-sectional view of a bolt action design, wherein a large extractor having extractor projection requires a bolt action bolt-head design of a large diameter, and thus establishes a gap between the end of bolt head and the breech end of either a barrel or a barrel extension.

FIG. 15A depicts a partial cross-sectional view of a bolt action design. As noted in FIG. 15A, a large extractor 152 having extractor projection 152*a* forces a bolt action bolt-head 130*a* design of a large diameter, and would establish a gap 138 between the end of bolt head 130*a* and the breech end of either a barrel or a barrel extension. In the instant FIG. 15A, a portion of barrel extension 121 is shown.

The clearance of gap 138 leaves an area of propellant charge 39 inadmissibly exposed to external pressure, which upon firing would damage the propellant charge, especially given that most propellant charges comprise plastic cases prone to break under high pressure.

Figure 15B:
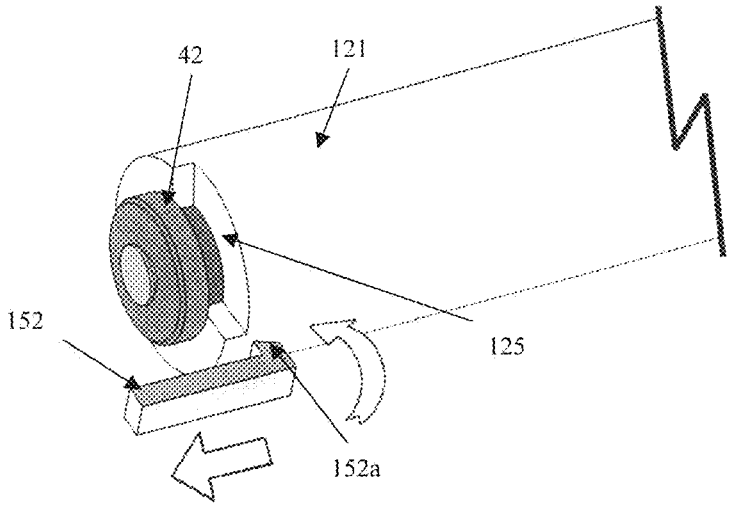
FIG. 15B depicts a partial cross-sectional view of a barrel extension with a gap or notch in the breech end to expose the bottom side of the rim which allows the rim to contact an extractor.

As depicted in FIG. 15A, a bolt head/extractor combination will not easily accommodate a flush mounted propellant charge without exposing a gap. FIG. 15B depicts a partial cross-sectional view of a barrel extension 121 with a gap or notch 125 in the breech end to expose the bottom side of rim 42 and receive an extractor 152. In order to remove the flush-mounted propellant charge from the breech end of a barrel extension, the barrel extension notch 125 permits extractor 152 to rotate between the breech end of barrel extension 121 and the propellant charge rim 42.

Figure 16:
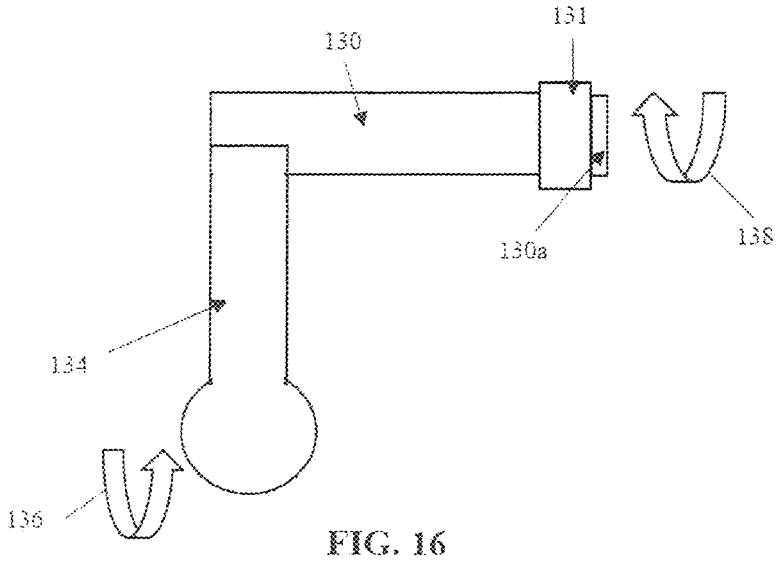
FIG. 16 depicts a one-piece bolt design, where rotation of the bolt handle rotates bolt simultaneously.

Generally, a bolt action firearm has the bolt and the bolt handle formed as an interlocking or one-piece design, such that rotation of the bolt handle simultaneously rotates the bolt. FIG. 16 depicts a one-piece bolt design, where rotation of bolt handle 134 rotates bolt 130 simultaneously. Bolt 130 has a diameter that exceeds the diameter of the propellant charge rim. Bolt lug 131 is depicted having a larger diameter that extends beyond the bolt diameter.

Arrows 136 and 138 depict the different rotational directions of the bolt handle 134 and bolt 130, respectively. In this design, the lugs 131 situated on bolt head 130*a* extend radially outwards demonstratively more than the bolt diameter. This allows for locking the bolt upon loading. Referring to FIG. 15A, the rotation of bolt head 131*a* and extractor 152 can be completed since extractor 152 projects into gap 125.

As shown, given the size of the present propellant charge and its flush-mounted positioning, the diameter of the bolt, "D", must be at least as large as or larger than the diameter "d" of rim 42. Furthermore, designs of a bolt action firearm capable of accommodating the present propellant charge must include a gap that exposes at least a portion of the propellant charge casing, and as shown in FIG. 15B, a large gap or cavity 125 in the breech end of the barrel extension is necessary to receive a pivoting projection 152*a* from extractor 152, otherwise other extraction means would be required to remove a flush-mounted propellant charge.

Figure 17A:
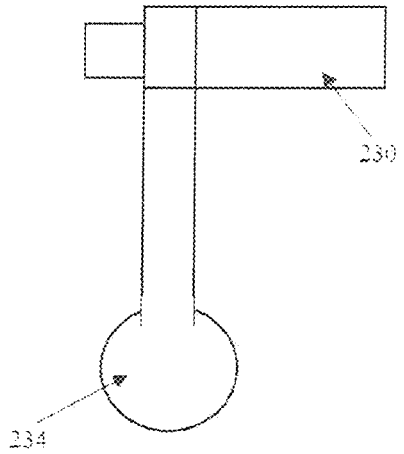
FIG. 17A depicts a two-piece bolt design (bolt handle and bolt) where the bolt is not rotated when the bolt handle is rotated.
Figure 17B:
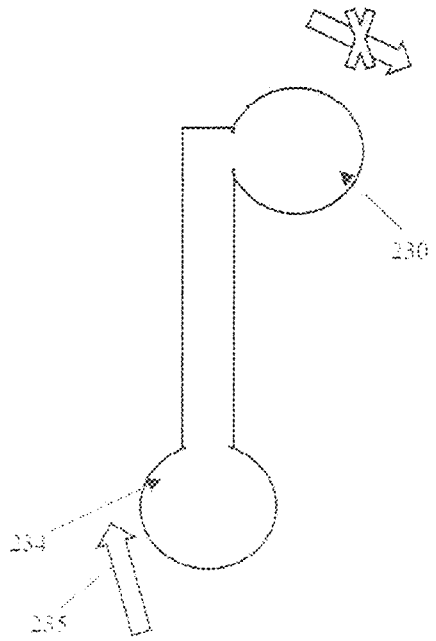
FIG. 17B depicts the rotational direction of the bolt design of FIG. 17A, where the bolt handle is rotated, and the bolt is not.

FIG. 17A depicts a two-piece bolt design (bolt handle 234 and bolt 230). In this two-piece design, the bolt 230 is not rotated when the bolt handle 234 is rotated. FIG. 17B depicts the rotational direction of the bolt handle 234 by arrow 235, and the lack of rotation of the bolt 230. This two-piece embodiment provides for a more compact design where the extra size and expanse of the bolt lugs may be reduced or as shown here, omitted.

Figure 18:
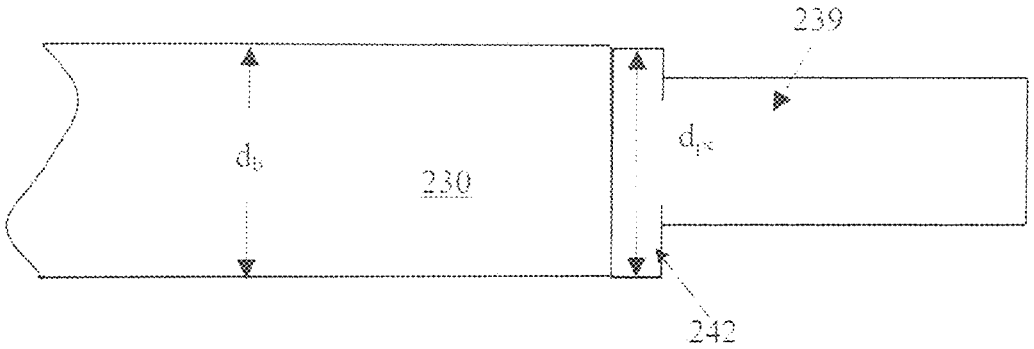
FIG. 18 depicts a partial cross-sectional view of the two-piece bolt design of FIG. 17, showing the bolt face abutting a propellant charge.

FIG. 18 depicts a partial cross-sectional view of the two-piece bolt design of FIG. 17, showing bolt 230 abutting a propellant charge 239. In this embodiment, bolt 230 diameter, $d_b$, is approximately the same length as the propellant charge rim 242 diameter, $d_{pc}$. Due to the absence of rotation of the bolt, it is possible to reduce the diameter of the bolt, and even omit the bolt lugs as compared to the one-piece bolt design of FIG. 16.

Furthermore, due to the lack of bolt rotation in the two-piece bolt design of FIG. 17, it is possible to reduce greatly the width of the gap in the breech end of the barrel extension that receives the extractor projection.

Figure 19:
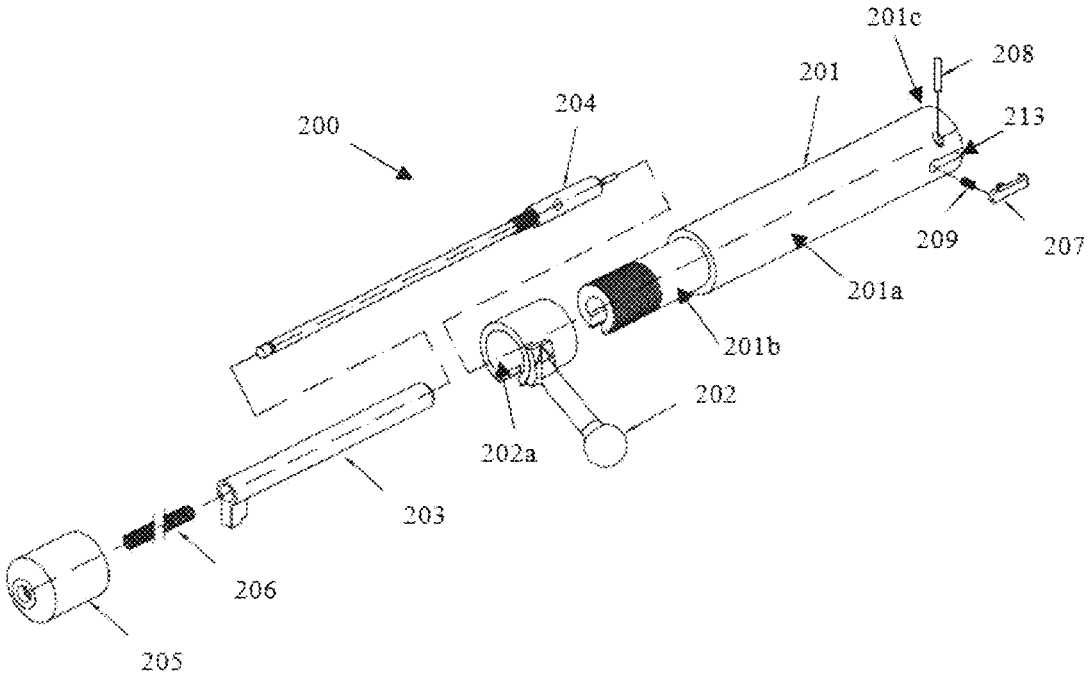
FIG. 19 is an explosive view of an embodiment of a two-piece bolt assembly with a bolt configured to the approximate dimensions of a propellant charge.

FIG. 19 is an explosive view of an embodiment of a bolt assembly 200 configured to the dimensions of a propellant charge. The propellant charge may be as described above and depicted in FIGS. 1 and 2. It should be noted that other propellant charges of like design but different diameter or caliber may also be utilized provided the dimensions of the bolt and barrel are complementary accommodating. Bolt body 201 is a component of the bolt assembly that is not designed to rotate within the inside of the receiver, thus in part reflecting a straight-pull action. Bolt body 201 slides forward in the direction of the rifle muzzle end when placed in a CLOSED position, and slides back away from the rifle muzzle end, in the direction of the rifle breech end, when placed in an OPEN position. Bolt body 201 is in mechanical communication with bolt handle or lever 202 and the bolt handle casing 202*a*, which the user operates to move the bolt body forward in the direction of the rifle muzzle end and aft towards the breech end.

Bolt body 201 is configured of a first section having a first diameter and a second section having a second diameter, wherein the first diameter is larger than the second diameter.

Figure 20:
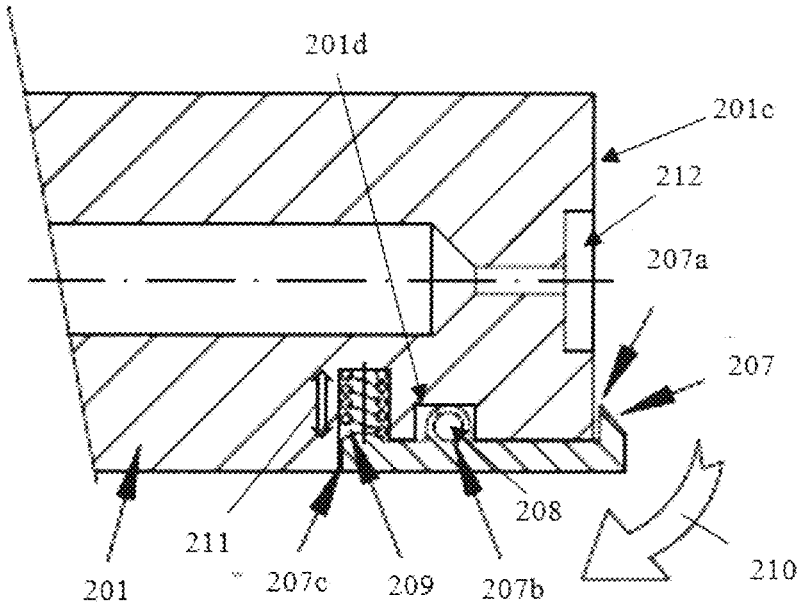
FIG. 20 depicts a cross-sectional view of the bolt head of FIG. 19 showing the extractor assembly.

At one end of bolt 201 is an extractor assembly that aids in removing a spent propellant charge after firing. Extractor 207 is located proximate the bolt head 201*c* of bolt 201. FIG. 20 depicts a cross-sectional view of the bolt head 201*c* showing the extractor assembly. Extractor 207 is located within slot 213 of bolt 201. Extractor 207 is designed with an extended protrusion or hook 207*a* at one end for interaction with the propellant charge (not shown), preferably the rim of the propellant charge. A protruding ring-shaped aperture 207*b* is provided approximately midway between extended protrusion 207*a* at one end and extractor end 207*c* at the opposing end. Aperture 207*b* extends outwards from extractor 207 in the direction of bolt 201, and is received in bolt 201 by a formed slot or indentation 201*d*.

Aperture 207*b* receives holding pin 208, which secures extractor 207 to the bolt head, and allows for a pivot axis for the extractor to revolve about pin 208 under a resilient force applied to extractor end 207*c* by a resilient mechanism 209, such as a spring, which may also be internal to the bolt head 201*c*, as is depicted in FIG. 20. This configuration allows extractor 207 to pivot about pin 208 to an open position in the direction of arrow 210, which in turn compresses resilient mechanism 209 in the direction of arrow 211. Extractor 207 is biased closed by resilient mechanism 209.

Figure 21:
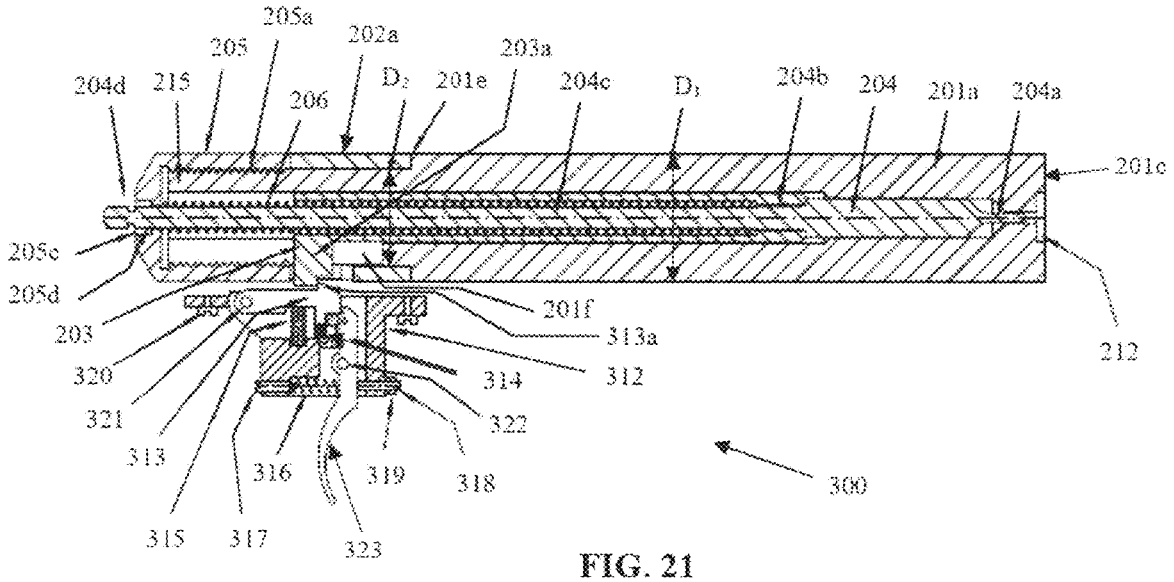
FIG. 21 depicts a cross-sectional view of the bolt assembly of FIG. 19 with a trigger housing, when the bolt action rifle is in the CLOSED (ready to fire) position.

FIG. 21 depicts a cross-sectional view of bolt assembly 200 and trigger housing 300, when the bolt action rifle is in the CLOSED (ready to fire) position. Bolt 201 is shown with a primer recess 212 that is designed to receive an extended primer of a propellant charge, wherein the extended primer extends longitudinally beyond the rim of the propellant charge. One function of the primer recess 212 is to ensure upon firing that the firing pin 204 with firing tip 204*a* does not protrude from the plane of the front face of bolt head 201*c*. In this manner, the use of a propellant charge other than the requisite propellant charge, that does not extend fully into the primer recess 212, will not be activated by the firing pin tip 204*a*, as the tip most likely will not reach the propellant charge primer.

As depicted in FIGS. 19 and 21, the body of bolt 201 has two distinct diameters, D1 and D2, thus producing a step 201*c* in the bolt diameter at the junction of the two separate diametric sections. D1 representing the diameter of the larger diameter section 201*a* of bolt 201, and D2 representing diameter of the smaller diameter section 201*b*. Bolt casing 202*a* rotates about smaller diameter bolt section 201*b* and is prevented from traversing longitudinally all the way to the bolt head 201*c* by a mechanical stop 201*e* formed by the junction of the different diameters. Located aft the rotatable bolt casing 202*a* is a threaded portion 215 on the bolt smaller section 201*b* for mating with plug 205. On one exposed side, on its lower surface in proximity of the trigger housing, bolt 201*b* has a longitudinal groove 201*f*, through which a key 203*a* located on the firing pin receptacle 203 is able to slide.

Figure 37A:
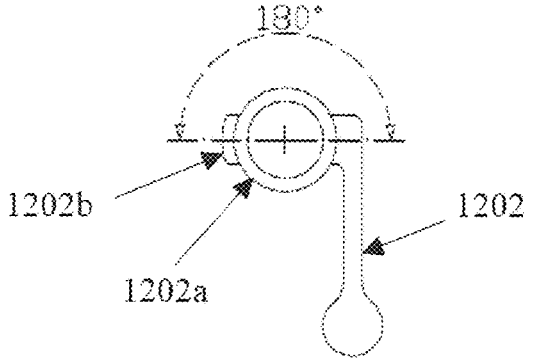
FIG. 37A depicts a bolt lever and bolt casing having a dual bolt lug design, with a first bolt located diametrically opposed of the bolt lever attachment, which acts as the second bolt lug, 180° apart circumferentially about the bolt casing.
Figure 37B:
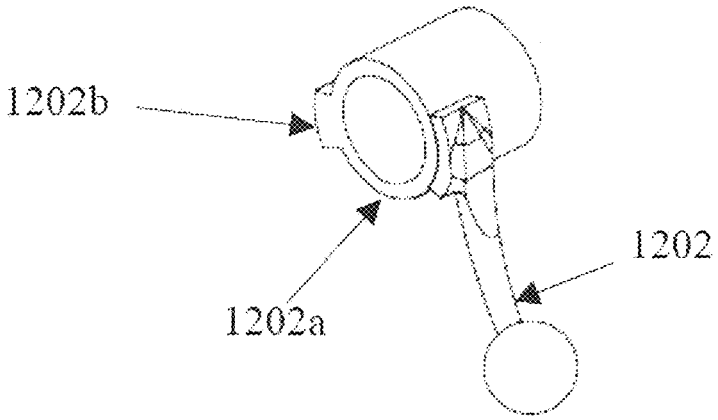
FIG. 37B depicts a perspective view of the bolt lever/bolt casing combination of FIG. 37A.

FIG. 37A depicts a bolt lever 1202 and bolt casing 1202*a* which presents a dual bolt design with bolt lug 1202*b* located diametrically opposed of the bolt lever attachment, 180° apart circumferentially about the bolt casing. The bolt lever base being the second bolt lug in the design. FIG. 37B depicts a perspective view of the bolt lever/bolt casing combination of FIG. 37A.

Figure 38A:
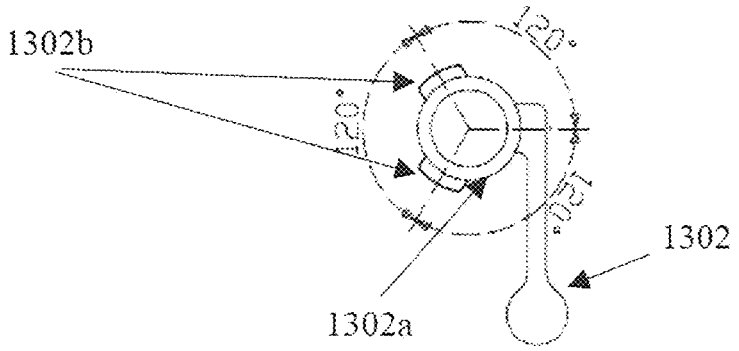
FIG. 38A depicts a bolt lever and bolt casing having a tri-bolt lug design, with each bolt lug spaced 120° apart circumferentially about the bolt casing with respect to each other and bolt lever, which acts as a third bolt lug.
Figure 38B:
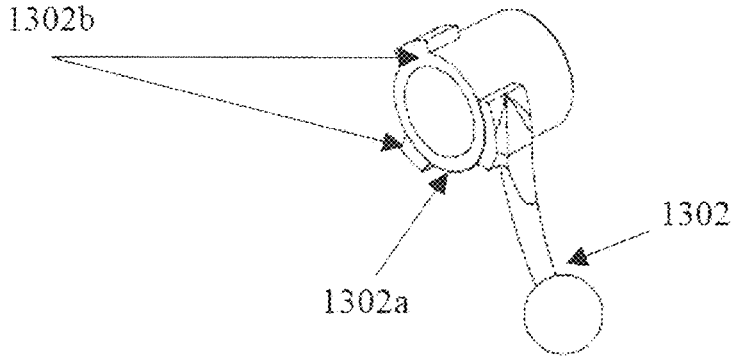
FIG. 38B is a perspective view of the bolt lever/bolt casing combination of FIG. 38A

FIG. 38A depicts a bolt lever 1302 and bolt casing 1302*a* having a tri-bolt lug design, with bolt lugs 1302*b* spaced 120° apart circumferentially about the bolt casing with respect to each other and a third bolt lug formed by the base of the bolt lever 1302. FIG. 38B is a perspective view of the bolt lever/bolt casing combination of FIG. 38A.

It is noted that a plurality of bolt lugs may be spaced equidistant on the bolt casing, extending radially outward from the bolt casing. In one embodiment, a single bolt lug presented by the bolt lever attachment is used alone.

The firing pin 204 is constructed with a rounded tip 204*a* to provide a striking hammer for the primer of the propellant charge. Opposite the rounded tip 204*a* is a threaded portion 204*b*. The firing pin 204 traverses the bolt longitudinally and includes a cylindrical midportion 204*c* around which is secured a resilient mechanism, such as a spring 206. At the rear or breech end of firing pin 204 is a firing pin safety indicator 204*d*, which is generally a visual marker, such as a slot which may also be colored for visual indication, and which serves as an indicator to let a user know that the rounded tip striking hammer 204*a* is loaded and ready to fire.

A threaded plug 205 holds the aforementioned components in place under the resilient force of spring 206. Threaded section 205*a* secures plug 205 to bolt section 201*b*. Plug 205 preferably includes a shaped hole or aperture at the back or breech end, preferably a hexagonally shaped hole or aperture, which can be tightened or loosened with the aid of a wrench. It also allows for firing pin safety indicator 204*d* to move forward and aft, and to be viewed.

Under bolt assembly 200 is the trigger housing assembly 300. Trigger housing assembly 300 defined herein is not essential to the bolt assembly design of the present invention, but is described generally to detail the interaction of bolt assembly 200 with a trigger assembly.

Trigger assembly 300 is enclosed in housing 312 and has a sear 313 with pin 303. Sear 312 revolves about pin 321 and includes a hooking tooth or segment 313*a*. Sear spring 315 allows the sear up and down motion towards and away from the receiver. Safety 314 has two positions, a shot position and a safe position. When the trigger is compressed by the user, moving it backwards towards the rifle breech end, the axis of rotation causes sear 313 to drop under pressure of firing pin 204 and spring 206 causing triggering. Trigger spring 316 is adjustable by a pressure regulating screw 317. A hitch adjusting screw 318 is situated at the lower end of trigger housing 312.

Figure 22:
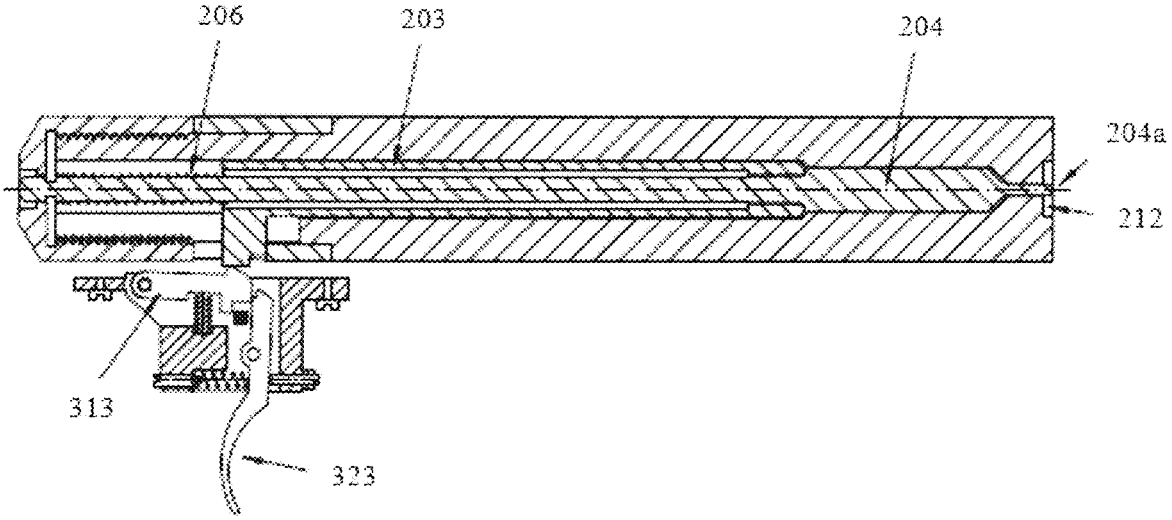
FIG. 22 depicts the embodiment of FIG. 19, wherein the firing pin has entered the primer recess, and the rifle has been shot.

FIG. 22 depicts the embodiment of FIG. 19, wherein the firing pin has entered the primer recess, and the rifle has been shot. Trigger 323 has been moved backwards towards the breech end of the rifle, releasing sear 313, which in turn releases firing pin receptacle 203, and allowing firing pin 204 to be driven by resilient mechanism 206. The tip 204*a* of firing pin 204 enters the primer recess cavity 212.

Figure 23:
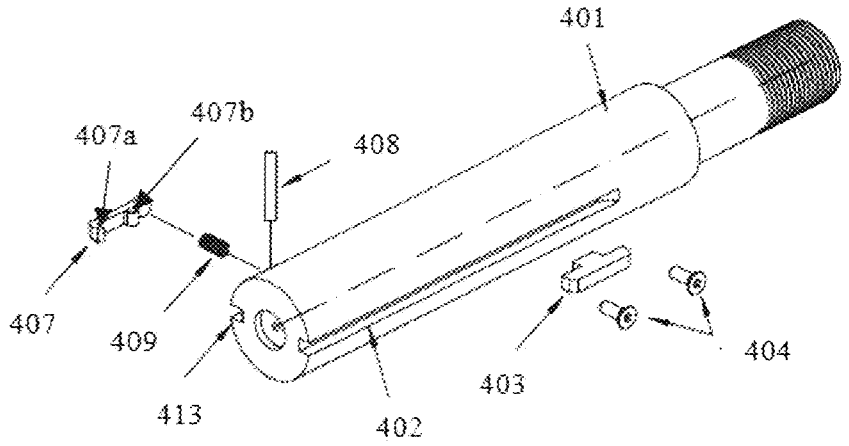
FIG. 23 depicts an exploded view of the bolt of FIG. 19 presenting an embodiment for an ejector.

FIG. 23 depicts an exploded view of an embodiment for an ejector. Bolt 401 is depicted with a longitudinal slot 402. An ejector 403 is configured to traverse within longitudinal slot 402. Ejector 403 may be attached by screws 404 (as depicted) or by other attachment means common in the art as long as ejector 403 is permitted to slide within slot 402. When bolt 401 is moved backwards towards the breech end of the rifle, extractor 407 removes (pushes) the propellant charge 39 away from the bolt head. As this action occurs, ejector 403 extends beyond the face of bolt 401. For illustrative purposes only, an embodiment of the design of extractor 407 shown is as described above in Fig. B.

Figure 24:
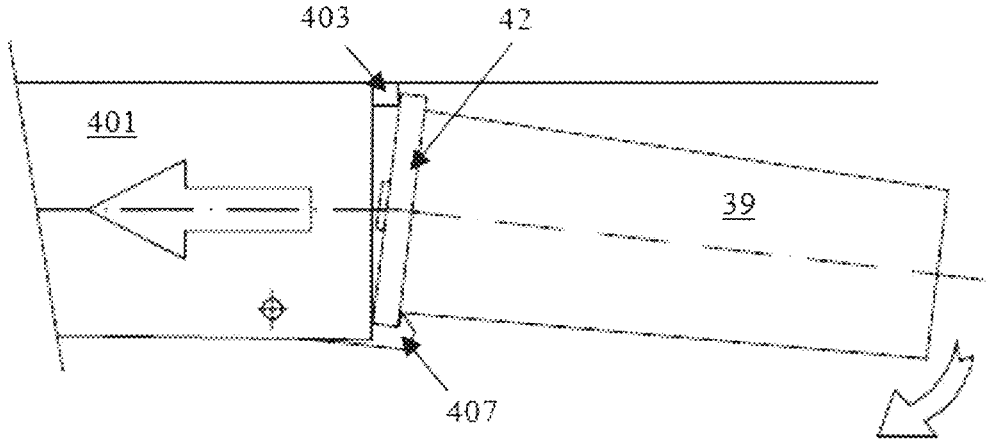
FIG. 24 depicts an end portion of the bolt of FIG. 23 with the ejector exposed beyond the face of the bolt, pushing the propellant charge away from the bolt face, as an extractor, diametrically opposed from the ejector, holds the rim of the propellant charge.

FIG. 24 depicts an end portion of ejector 403 exposed beyond the face of bolt 401, pushing propellant charge 39 away from the bolt face, as extractor 407, diametrically opposed from ejector 403, holds the rim 42 of propellant charge 39. Together, these components cause the propellant charge to rotate away from the bolt face.

Extractor 407 is located within slot 413 of bolt 401. Extractor 407 is designed with an extended protrusion or hook 407*a* at one end for interaction with the propellant charge (not shown). A protruding aperture 407*b* is provided approximately midway between extended protrusion 407*a* and the opposing extractor end. Aperture 407*b* receives holding pin 408, which secures extractor 407 to the bolt head, and allows for a pivot axis for the extractor to revolve about pin 408 under a resilient force applied to the extractor end by a resilient mechanism 409, such as a spring. This configuration allows extractor 407 to rotate about pin 408, which in turn compresses or extends resilient mechanism 409. Extractor 407 is biased against bolt 401 by resilient mechanism 409.

Figure 25A:
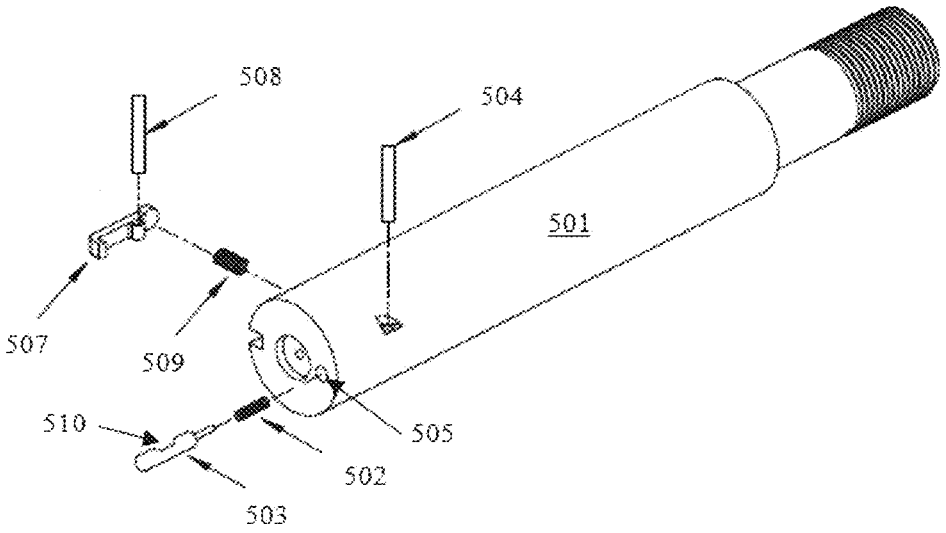
FIG. 25A depicts a second embodiment for an ejector in the proposed bolt assembly, wherein the ejector is continually under an outwardly directing bias force provided by a resilient member.

FIG. 25A depicts a second embodiment for an ejector in the proposed bolt assembly. In this embodiment, ejector 503 is continually under an outwardly directing bias force provided by a resilient member, such as spring 502. Ejector 503 includes an indentation or recess 510 which, upon insertion into cavity 505 in bolt 501, allows set pin 504 to restrain ejector 503 from the outwardly applied bias force of spring 502. Recess 510 is elongated to allow ejector 503 to slidably engage about set pin 504.

Figure 25B:
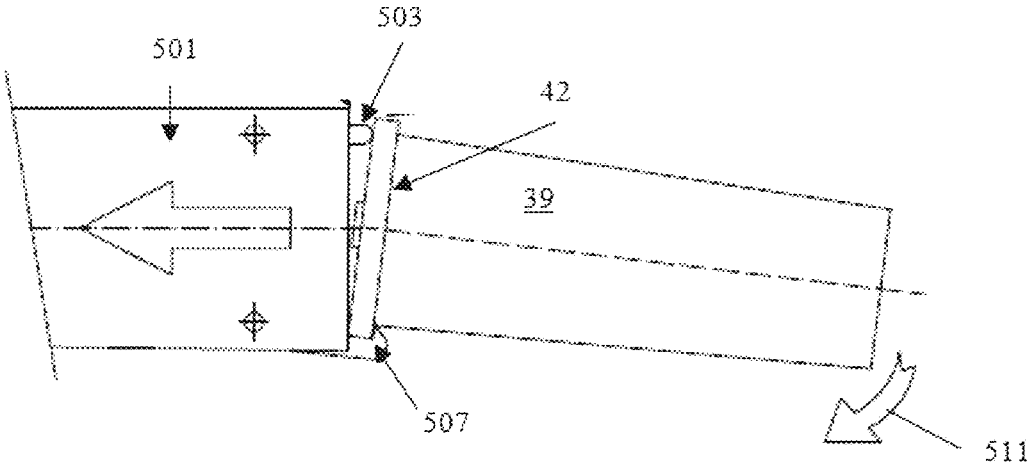
FIG. 25B depicts the ejector embodiment of FIG. 25A, showing the ejection of propellant charge.

FIG. 25B depicts the ejector embodiment of FIG. 25A, showing the ejection of propellant charge 39. The end portion of ejector 503 is exposed beyond the face of bolt 501, pushing propellant charge 39 away from the bolt face, as extractor 507, diametrically opposed from ejector 503, holds the rim 42 of propellant charge 39, causing the propellant charge to rotate in the direction of arrow 511 away from the bolt face.

Figure 26A:
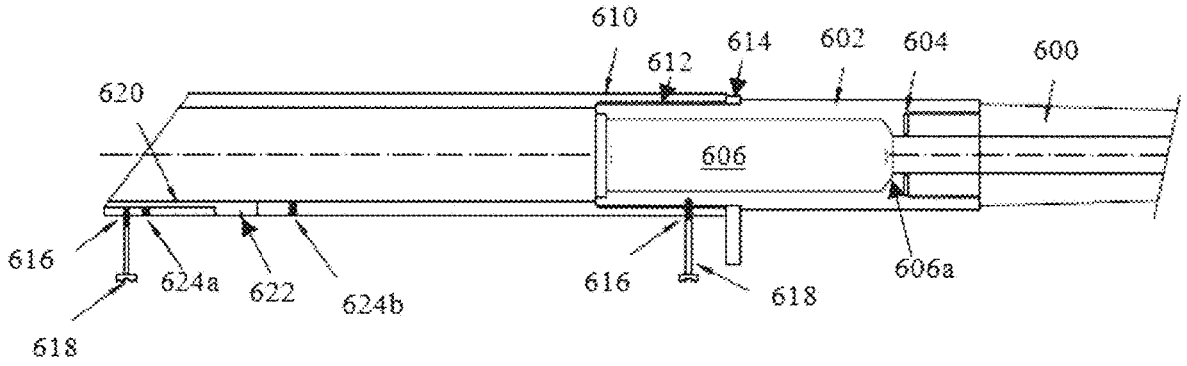
FIGS. 26A and 26B depict another ejector embodiment.
Figure 26B:
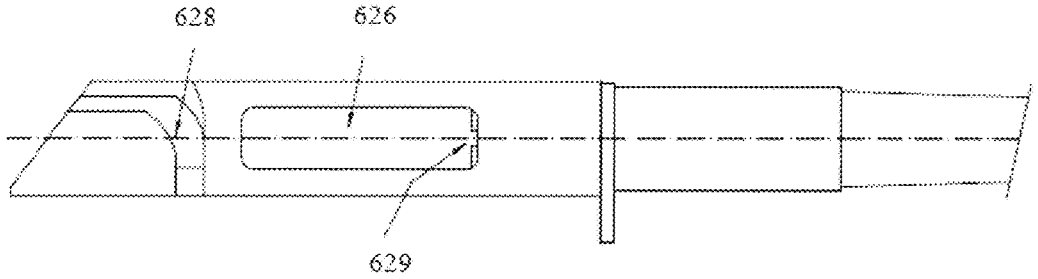

FIGS. 26A and 26B depict a receiver modified for ejection of the propellant charge. FIG. 26A is a cross-sectional view of the barrel and barrel extension attached to a receiver 610. Barrel 600 is threaded to barrel extension 602 with a gas sealing ring 604 secured therebetween upon attachment. As described in other embodiments above, barrel extension 602 includes a chamber 606 for receiving a propellant charge, chamber 606 having a constricted portion 606*a* proximate the junction of barrel 600 with barrel extension 602. This constricted portion 606*a* prevents loading a projectile from the barrel extension's breech end. Rifle receiver 610 includes a threaded portion 612 to form an attachment with a complementary threaded portion of barrel extension 602.

A recoil lug 614 is situated between the receiver 610 and the barrel extension 602. Recoil lug 614 rests on the stock to withstand the forces of recoil when shooting. One attachment scheme to affix the receiver to the stock includes threaded holes 616 to receive fixing screws 618. Other attachment means are possible, and are not excluded for the present invention.

At the back of receiver 610, a slot 620 is presented for receiving a key 630 of firing pin 632, and an aperture 622 for receiving the sear. Threaded holes 624*a,b* are presented as a means for fixing the trigger housing to the receiver.

FIG. 26B is a cross-sectional view of receiver 610 with an exposed aperture for ejection of the propellant charge. On one side of the receiver is an elongated aperture 626 through which propellant charges may be loaded or unloaded. Proximate aperture 626, towards the breech end, is a slot 628 to receive a bolt handle. The bolt handle, by fitting into slot 628, can put the bolt action in the CLOSED position, ready for firing. This position secures the bolt such that pressure of the gases exerted during firing cannot cause the bolt action to open. An extractor slot 629 can be seen through aperture 626.

Figure 26C:
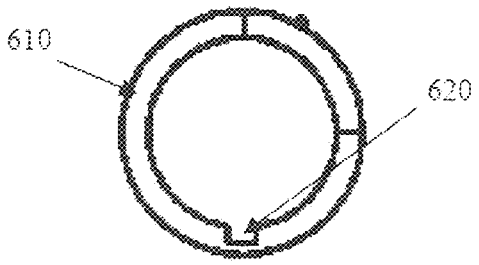
FIG. 26C is a front cross-sectional perspective view of the receiver of FIG. 26A depicting a slot as a carve-out on the annular ring presented by the receiver end.

FIG. 26C is a front cross-sectional perspective view of the receiver 610 of FIG. 26A depicting slot 620 as a carve-out on the annular ring presented by the receiver end.

Figure 27:
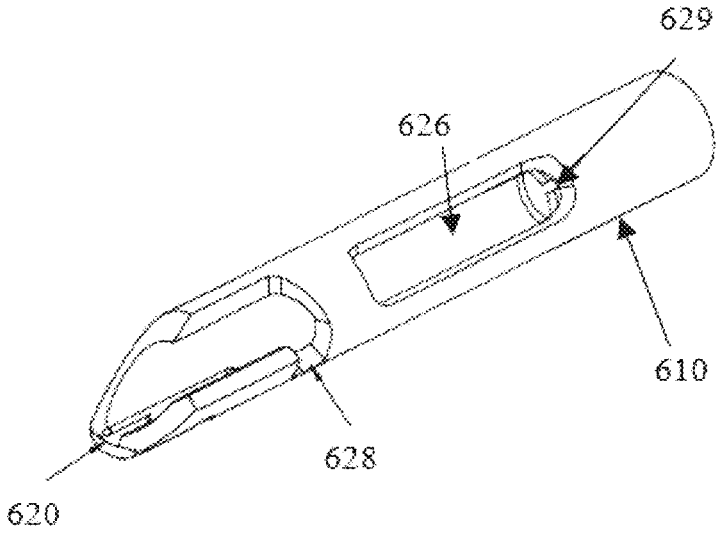
FIG. 27 depicts a top perspective view of the receiver of FIGS. 26A and 26B.

FIG. 27 depicts a perspective view of receiver 610. The window or aperture 626 for loading and unloading propellant charges is shown with extractor slot 629 visible at the forward end. Bolt handle (locking) slot 628 and hammer pin or key slot 620, through which key 630 for the firing pin runs, are visible at the breech end of the receiver.

Figure 28:
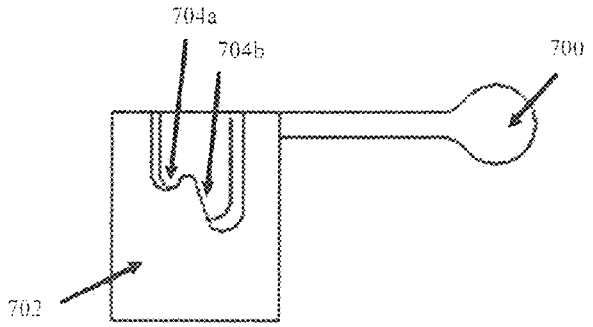
FIG. 28 depicts locking lever or bolt lever connected to a bolt handle case or assembly cam showing cam notches for securing the bolt case position.

FIG. 28 depicts locking lever or bolt lever 700 that is connected to a bolt handle case or assembly cam 702 showing cam notches 704. Cam notches 704*a,b* are utilized during the transformation of the movement of rotation of the locking lever 700 from rotational movement to a linear action on the bolt. At the end of the rotation when the bolt action is in the CLOSED position, the end of the firing pin key is in mechanical contact with the sear.

Figure 29A:
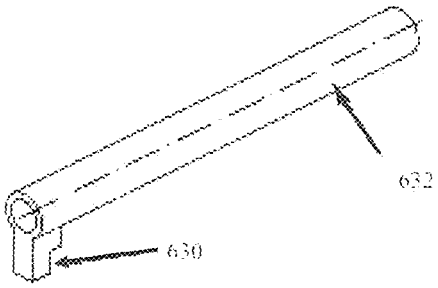
FIG. 29A depicts a top perspective view of a firing pin with extending key proximate one end of the firing pin.
Figure 29B:
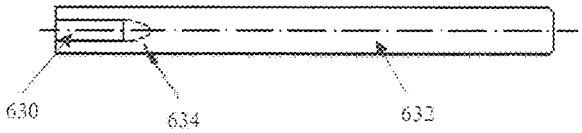
FIG. 29B depicts a bottom perspective view of the firing pin of FIG. 29A, illustrating the rounded edge of the extended key.

FIG. 29A depicts a top perspective view of the firing pin 632 with extending key 630 proximate one end of the firing pin. FIG. 29B depicts a bottom perspective view of the firing pin 632 of FIG. 29A, illustrating the rounded edge 634 of key 630. When the lever is fully open, the front rounded edge 634 of firing pin key 630 is temporarily retained in notch 704*a* of the bolt handle case 702.

Figure 30:
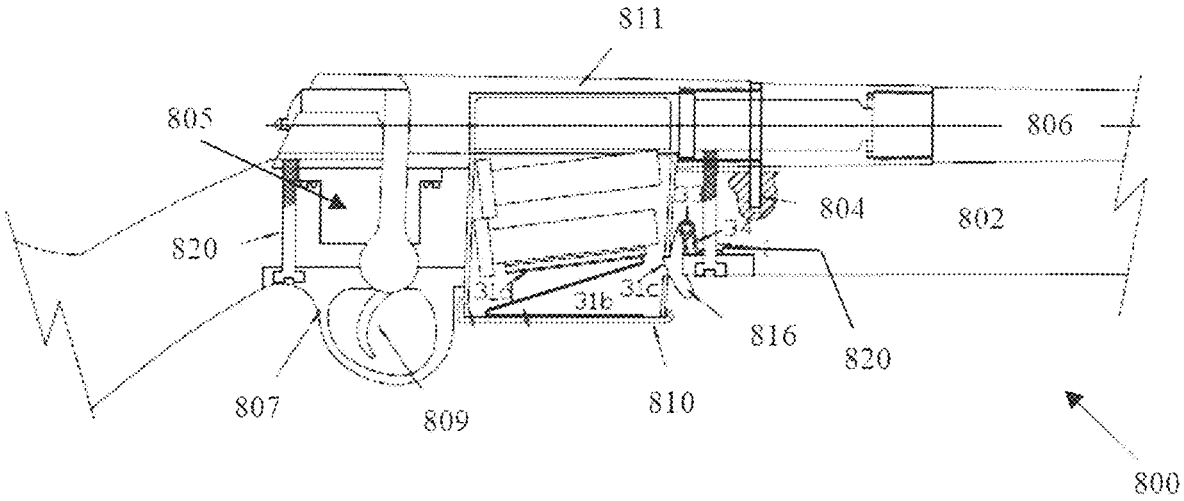
FIG. 30 is a cross-sectional partial view of a muzzleloader bolt action rifle with a magazine 810 inserted therein.
Figure 31:
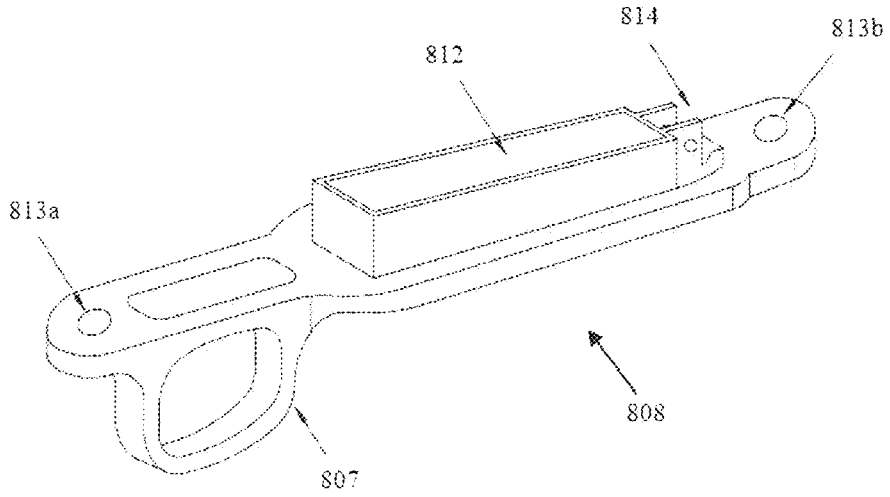
FIG. 31 is a top perspective view of the trigger guard casing for use in the muzzleloader bolt action rifle of FIG. 30.

FIG. 30 is a cross-sectional partial view of a muzzleloader bolt action rifle 800 with a magazine 810 inserted therein. The stock 802 is secured within an adjustment groove 804. The trigger guard 807 attaches underneath the stock 805 and the rifle receiver 811. FIG. 31 is a top perspective view of trigger guard casing 808. Trigger guard casing 808 includes a rectangular aperture 812 for receiving a magazine. Two screw holes 813*a,b* allow for the trigger guard casing 808 to attach to the stock. Fixing screws 820 are used to make this attachment.

Figure 32:
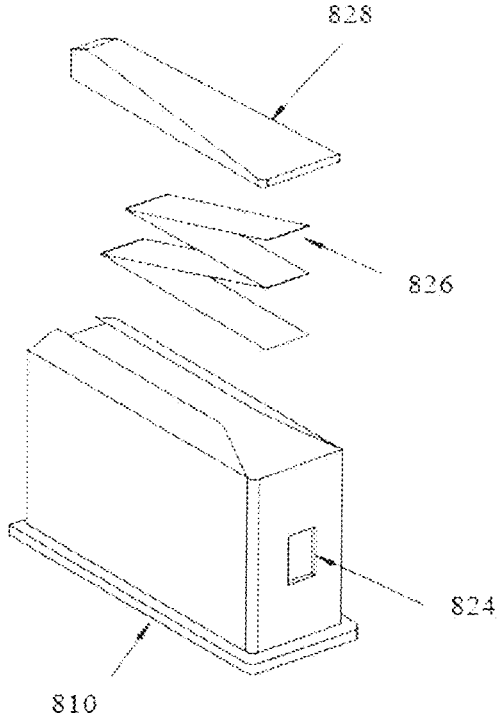
FIG. 32 is an exploded view of the magazine used in the muzzleloader bolt action rifle of FIG. 30.

FIG. 32 is an exploded view of magazine 810. In front of the magazine housing there is a slot 824 that serves to receive a magazine retaining lever 816, and retain the magazine 810 when the magazine is inserted within the rectangular aperture 812 of trigger guard casing 808. Inside the magazine housing 810 is a lifting spring 826 for biasing the propellant charges upwards towards the receiver. A support tile 828 serves to guide each propellant charge into the chamber.

Figure 33:
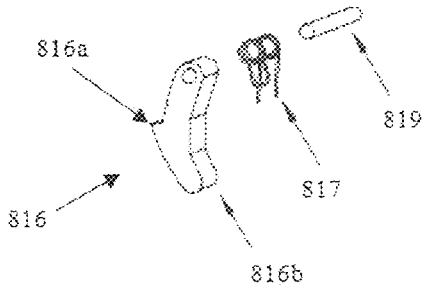
FIG. 33 depicts an exploded view of the spring biased, pivotable magazine retaining lever which is insertably held within a slot in the magazine housing, locking the magazine housing in place.

FIG. 33 depicts an exploded view of the spring biased, pivotable magazine retaining lever 816 which is insertably held within slot 824, locking the magazine housing in place. Magazine retaining lever 816 is biased by spring 817, and pivots about pin 819. Magazine retaining lever 816 includes a protrusion 816*a* insertable within slot 824. A finger accessible portion 816*b* allows the user to release the magazine after use.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A bolt action rifle having a bolt action assembly, said bolt action assembly comprising:

a receiver;

a substantially cylindrical shell, single bolt body in slidable communication with said receiver, said bolt body having a first portion with an outer surface having a first diameter and a second portion with an outer surface having a second diameter, said second diameter less than said first diameter, wherein said first and second bolt portions form a step at a junction where said first and second bolt portions meet, said bolt first portion having an exposed bolt face and a recess with an aperture therein for receiving a firing pin tip, said bolt second portion having an attachment mechanism on an end opposite said bolt face;

a bolt lever attached to or integral with a bolt casing, wherein said bolt casing forms an annulus insertable around and coaxial with said bolt second portion outer surface such that said bolt casing and bolt lever are rotatable about said bolt second portion without rotating said bolt second portion, and said bolt lever and bolt casing are in slidable communication with said bolt second portion and said receiver;

a firing pin insertable within and in slidable communication with said bolt, said firing pin having said firing pin tip at an end proximate said bolt face;

a resilient mechanism applying a bias force to said firing pin when said bolt lever and bolt casing are held forward in a closed, firing position, said bias force pushing said firing pin towards said bolt face; and a plug attached to said bolt second portion at said attachment mechanism, said plug providing a mechanical stop or said resilient mechanism.

2. The bolt action rifle of claim 1 wherein said bolt first portion includes a slot or aperture for housing an extractor mechanism proximate said bolt face.

3. The bolt action rifle of claim 2 wherein said extractor mechanism includes an extractor lever having a hook or protrusion on a first end, a second end opposite said first end in mechanical communication with a biasing resilient component, a protruding aperture situated between said first and second ends, and a pivot pin insertable within said bolt and said protruding aperture, said pivot pin allowing said extractor mechanism to pivot away from and towards said bolt.

4. The bolt action rifle of claim 3 wherein said hook or protrusion on said first end of said extractor lever configured to hold a rim of a propellant charge to said bolt face.

5. The bolt action rifle of claim 1 wherein said bolt first portion includes an ejector mechanism for dislodging a propellant charge from said bolt face after firing, said ejector slidably extendable through said bolt face adjacent said recess.

6. The bolt action rifle of claim 5 wherein said ejector mechanism includes a slot within said bolt first portion and an ejector slidable therein, such that said ejector is biased forward beyond said bolt face when said bolt first portion is pulled back in a direction opposite a muzzle end of the bolt action rifle.

7. The bolt action rifle of claim 5 wherein said ejector mechanism includes an ejector pin located within an aperture accessible on said bolt face, said ejector pin biased forward in a direction beyond said bolt face by a resilient mechanism, and having an indentation for receiving a set pin such that said ejector pin slidable path towards and away from said bolt face is restricted by said set pin between said indentation.

8. The bolt action rifle of claim 7 wherein said set pin is insertable within said bolt first portion in a direction perpendicular to said ejector pin motion.

9. The bolt action rifle of claim 1 wherein said receiver includes an aperture through which propellant charges may be loaded or unloaded, and a slot to receive a bolt handle proximate said aperture, such that the bolt handle, by fitting into said slot, puts the bolt action in the CLOSED position, ready for firing.

10. The bolt action rifle of claim 1 including a trigger housing having a rectangular aperture for receiving a magazine.

11. The bolt action rifle of claim 10 including a magazine retainer mechanism comprising a magazine retaining lever, a biasing spring, and a pivot structure for biasing said magazine retaining lever towards said magazine.

12. The bolt action rifle of claim 11 wherein said magazine includes a slot for receiving a portion of said magazine retaining lever to secure said magazine.

13. The bolt action rifle of claim 1 wherein said bolt action rifle is a muzzleloading rifle.

14. The bolt action rifle of claim 1 wherein said bolt casing includes a bolt lug extending radially outwards.

15. The bolt action rifle of claim 1 wherein said bolt casing includes multiple bolt lugs placed approximately equidistant apart along said bolt casing circumference.

16. The bolt action rifle of claim 1 including a magazine for holding a plurality of propellant charges said magazine releasably attachable to, and disposed underneath, said receiver, said magazine having a spring-loaded base for applying an insertion force on said propellant charges towards said receiver.

17. A bolt action rifle having a bolt action assembly, said bolt action assembly comprising:

a receiver;

a substantially cylindrical shell bolt body in slidable communication with said receiver, said bolt body having a first outer surface portion with a first diameter and a second outer surface portion with a second diameter, said second diameter less than said first diameter, wherein said first and second bolt outer surface portions form a step at a junction where said first and second bolt outer surface portions meet, said bolt first outer surface portion having an exposed bolt face, a primer cap recess, and an aperture for receiving a firing pin tip wherein said bolt face exposes the primer cap recess having said aperture therein;

a bolt lever attached to or integral with a bolt casing, wherein said bolt casing includes an annular ring portion insertable around and coaxial with said bolt second outer surface portion such that said bolt casing and bolt lever are rotatable about said bolt second outer surface portion without rotating said bolt second outer surface portion, and said bolt lever and bolt casing are in slidable communication with said bolt second outer surface portion and said receiver;

a firing pin insertable within and in slidable communication with said bolt, said firing pin having said firing pin tip at an end proximate said bolt face wherein said firing pin tip is insertable within said aperture of said exposed primer cap recess;

a resilient mechanism applying a bias force to said firing pin when said bolt lever and bolt casing are held forward in a closed, firing position, said bias force pushing said firing pin towards said bolt face; and a plug attached to said bolt second outer surface portion at an end opposite said bolt face, said plug providing a mechanical stop for said resilient mechanism.

18. The bolt action rifle of claim 5 wherein said ejector mechanism includes an ejector pin located within, and in slidable communication with, a slot on said bolt first portion outer surface, said ejector pin biased forward in a direction beyond said bolt face such that said ejector pin slides on a path towards and away from said bolt face.

* * * * *